US008733344B2

(12) United States Patent
Bozanic et al.

(10) Patent No.: US 8,733,344 B2
(45) Date of Patent: May 27, 2014

(54) MOUTHPIECE SUPPLY VALVE CONTROL SYSTEM

(76) Inventors: Jeffrey Evan Bozanic, Fountain Valley, CA (US); Forrest P. Gauthier, Key Largo, FL (US)

( * ) Notice: Subject to any disclaimer, the term of this patent is extended or adjusted under 35 U.S.C. 154(b) by 0 days.

(21) Appl. No.: 13/486,281

(22) Filed: Jun. 1, 2012

(65) Prior Publication Data

US 2012/0240936 A1 Sep. 27, 2012

Related U.S. Application Data

(62) Division of application No. 12/423,780, filed on Apr. 14, 2009, now Pat. No. 8,196,581.

(60) Provisional application No. 61/044,543, filed on Apr. 14, 2008.

(51) Int. Cl.

| | |
|---|---|
| ***B63C 11/02*** | (2006.01) |
| ***A62B 9/02*** | (2006.01) |
| ***B63C 11/24*** | (2006.01) |
| ***B63C 11/22*** | (2006.01) |

(52) U.S. Cl.

CPC ..... *B63C 11/24* (2013.01); *B63C 11/22* (2013.01)

USPC ..... 128/201.27; 128/204.26; 128/205.24; 128/205.28

(58) Field of Classification Search

CPC ..... A62B 9/02; A62B 9/027; A62B 18/10; B63C 11/24; B63C 11/22

USPC ..... 128/201.27, 201.28, 204.26, 204.27, 128/205.15, 206.15, 204.18, 205.21, 128/204.22, 204.29, 207.14, 207.16, 128/205.24, 205.27, 205.28, 200.24, 128/205.22; 405/185–189

See application file for complete search history.

(56) References Cited

U.S. PATENT DOCUMENTS

| | | | | |
|---|---|---|---|---|
| 4,802,472 | A * | 2/1989 | Jung | 128/204.18 |
| 5,127,398 | A * | 7/1992 | Stone | 128/204.18 |
| 6,712,071 | B1 * | 3/2004 | Parker | 128/204.21 |
| 2003/0188744 | A1 * | 10/2003 | Deas et al. | 128/201.27 |
| 2006/0201509 | A1 * | 9/2006 | Forsyth et al. | 128/204.26 |
| 2009/0101143 | A1 * | 4/2009 | Frimann | 128/201.28 |

* cited by examiner

*Primary Examiner* — Tan-Uyen T. Ho
*Assistant Examiner* — Peter S Vasat
(74) *Attorney, Agent, or Firm* — Baker & Hostetler LLP

(57) ABSTRACT

A mouth piece supply valve control system which may be used in connection with mouth piece supply valve with a rebreather. An exemplary mouth piece supply valve control system may include a sensor operative to produce a sensor signal upon sensing a condition, a computer connected to the sensor that may produce a computer signal associated with sensor signal, a logic device operatively connected to the computer for receiving the computer signal, and an automatic actuator operatively connected to the logic device. The automatic actuator may be operatively coupled to a mouth piece supply valve that may be selectable between a first mode and a second mode and the automatic actuator may shift the mouth piece supply valve from the second mode to the first mode upon receipt of a logic device signal from the logic device.

28 Claims, 15 Drawing Sheets

MOUTHPIECE SUPPLY VALVE CONTROL SYSTEM

CROSS REFERENCE TO RELATED APPLICATION

This application is a division of U.S. application Ser. No. 12/423,780, filed Apr. 14, 2009, now U.S. Pat. No. 8,196,581, issued Jun. 12, 2012, which claims the benefit of U.S. Provisional Application No. 61/044,543, filed Apr. 14, 2008, which are incorporated by reference.

BACKGROUND OF THE INVENTION

The present disclosure is direct to self-contained breathing apparatus and, more particularly, to mouthpiece supply valves for use with rebreather-type self-contained breathing apparatus.

Rebreather devices may collect exhaled respiration gas from a user; store, clean, and/or re-oxygenate the gas in a respiration loop; and then present the same respiration gas to the user for inhalation. Rebreather apparatus may be classified as semi-closed rebreathers (SCR) or closed circuit rebreathers (CCR). Some rebreather devices allow the user to breath gasses supplied from an external source (such as a compressed gas cylinder) using a bail-out valve (BOV) if the re-breather fails to perform the necessary gas renovation functions, or when desired by the user.

The present disclosure is made in contemplation of U.S. Pat. Nos. 5,127,398, 5,746,199, and 6,681,766, U.S. Patent Application Publication No. 2002/0157669, and PCT WO 2007/126317 A1, which are incorporated by reference into this Background section.

BRIEF SUMMARY OF THE INVENTION

Exemplary embodiments include mouthpiece supply valves which may be used in connection with a rebreather. An exemplary mouthpiece supply valve may include a housing, an inlet mushroom valve, an outlet mushroom valve, a supply gas regulator, an exhaust valve, and a mode selector. An exemplary mouthpiece supply valve may perform manual diluent valve, automatic diluent valve, overpressure relief valve, excess fluid ejection, and bail-out valve functions, for example.

In an aspect, a mouthpiece supply valve may include a housing having an interior; an inlet valve arranged to selectively admit a respiration gas to the interior of the housing from an inlet tube; an outlet valve arranged to selectively discharge the respiration gas from the interior of the housing to an outlet tube; a mouthpiece connector fluidicly coupled to the interior of the housing; a supply gas regulator operative to selectively admit a pressurized gas to the interior of the housing when a pressure within the interior housing is less than an ambient pressure; an exhaust valve arranged to selectively vent the interior of the housing when the pressure within the interior of the housing is greater than the ambient pressure; an overpressure valve fluidicly interposing the interior of the housing and the exhaust valve; a movable actuator operatively connected to the inlet valve, the outlet valve, and the overpressure valve; and a mode selector arranged to shift the actuator from a first position associated with a first mode to a second position associated with a second mode. In the first position, the actuator may allow operation of the inlet valve and the outlet valve such that the inlet valve opens when a pressure within the inlet tube is greater the pressure within the interior of the housing, the inlet valve shuts when the pressure in the interior of the housing is greater than the pressure within the inlet tube, the outlet valve opens when the pressure in the interior of the housing is greater than a pressure in the outlet tube, and the outlet valve shuts when the pressure in the outlet tube is greater than the pressure in the interior of the housing, and, in the first position, the overpressure valve may be spring-biased shut. In the second position, the actuator may be operative to maintain the inlet valve shut, the outlet valve shut, and the overpressure valve substantially open.

In a detailed embodiment, the inlet valve may be a mushroom valve; the outlet valve may be a mushroom valve; and the inlet valve and the outlet valve may be mounted to an axially slidable valve rod which is operatively coupled to the actuator, the valve rod having a first position corresponding to the first position of the actuator and a second position corresponding to the second position of the actuator.

In a detailed embodiment, the release rod may be biased towards its second position by a release rod spring, and the release rod spring may be operative to prevent the release rod from stopping in an intermediate position between the first position and the second position.

In a detailed embodiment, the valve rod may be biased towards its second position corresponding with the second position of the actuator.

In a detailed embodiment, the supply gas regulator may receive pressurized gas from a compressed gas source via a first stage regulator.

In a detailed embodiment, the mode selector may be connected to the actuator by an axially slidable release rod. In a detailed embodiment, the release rod may be axially slidable between a first position corresponding to the first position of the actuator and a second position corresponding to the second position of the actuator, and the release rod may be biased towards its second position corresponding with the second position of the actuator.

In a detailed embodiment, the mode selector may be manually operable by a user. In a detailed embodiment, manual operation of the mode selector may include translation and rotation of the mode selector. In a detailed embodiment, the mode selector may be automatically operable in response to a sensed condition. In a detailed embodiment, the mode selector may be manually operable by the user between its first position and its second position, and the mode selector may be automatically shiftable from its first position to its second position in response to the sensed condition. In a detailed embodiment, the sensed condition may be associated with at least one of a partial pressure of a constituent of the respiration gas, a pressure, a temperature, and a component failure.

In a detailed embodiment, a mouthpiece supply valve may include an automatic actuator, which may include at least one of a solenoid, a pneumatic actuator, a squib, a thermal retention device, and a piezo crystal actuator.

In a detailed embodiment, the inlet valve and the outlet valve may be in fluidic communication with a rebreather.

In a detailed embodiment, the exhaust valve may include an exhaust valve diaphragm interposing the interior of the housing and an ambient environment.

In a detailed embodiment, the supply gas regulator may be operable manually via a button and automatically by a supply gas regulator diaphragm.

In a detailed embodiment, the actuator may be operatively connected to the supply gas regulator. In a detailed embodiment, in the first position, the actuator may be operative to select a first differential pressure setpoint for the supply gas regulator. In a detailed embodiment, in the second position, the actuator may be operative to select a second differential pressure setpoint for the supply gas regulator. In a detailed embodiment, the supply gas regulator may include a first spring arranged to bias a regulator inlet valve shut, a second spring arranged to selectively assist the first spring in biasing the regulator inlet valve shut, the first differential pressure may be associated with only the first spring, and the second differential pressure may be associated with the first spring and the second spring.

In an aspect, a self-contained breathing apparatus may include a rebreather arranged to renovate an exhaled gas rendering it suitable for inhalation; and a mouthpiece supply valve including a housing having an interior fluidicly coupled to a mouthpiece, a mode selector mounted to the housing and shiftable between a first position and a second position, an axially slidable release rod operatively coupled to the mode selector and shiftable between a first position and a second position, an actuator operatively coupled to the release rod and shiftable between a first position and a second position, the actuator including a base portion, a valve rod operatively coupled to the actuator and shiftable between a first position and a second position, the valve rod having a first end and a second end, an inlet mushroom valve mounted to the first end of the valve rod, the inlet mushroom valve being arranged to allow a respiration gas to flow from the rebreather into the interior of the housing via an inlet tube when the valve rod is in its first position and to prevent the respiration gas from flowing from the inlet tube into the interior of the housing when the valve rod is in its second position, an outlet mushroom valve mounted to the second end of the valve rod, the outlet mushroom valve being arranged to allow a respiration gas to flow from the interior of the housing to the rebreather via an outlet tube when the valve rod is in its first position and to prevent the respiration gas from flowing from the interior of the housing into the outlet tube when the valve rod is in its second position, an exhaust valve mounted to the housing and arranged to vent the interior of the housing to an ambient environment, an overpressure valve mounted to the housing and fluidicly interposing the interior of the housing and the exhaust valve, the overpressure valve being spring-biased shut when the actuator is in its first position and the overpressure valve fluidicly connecting the exhaust valve to the interior of the housing when the actuator is in its second position, and a second stage regulator valve assembly operatively connected to a source of pressurized gas and arranged to selectively admit the pressurized gas to the interior of the housing, the second stage regulator valve assembly being operative to admit the pressurized gas to the interior of the housing in response to manual actuation of a purge button and in response to a sensed pressure difference between the ambient environment and the interior of the housing.

In a detailed embodiment, the mode selector is manually operable by a user. In a detailed embodiment, manual operation of the mode selector may include translation and rotation of the mode selector.

In a detailed embodiment, the release rod may be biased towards its second position by a release rod spring, and the release rod spring may be operative to prevent the release rod from stopping in an intermediate position between the first position and the second position.

In a detailed embodiment, the mode selector may be automatically operable in response to a sensed condition. In a detailed embodiment, the sensed condition may be associated with at least one of a partial pressure of a constituent of the respiration gas, a pressure, a temperature, and a component failure.

In a detailed embodiment, a mouthpiece supply valve may include an automatic actuator, which may include at least one of a solenoid, a pneumatic actuator, a squib, a thermal retention device, and a piezo crystal actuator.

In a detailed embodiment, the release rod may be spring-biased towards its second position and the valve rod may be spring biased towards its second position.

In a detailed embodiment, the release rod and the valve rod may be arranged substantially in parallel.

In a detailed embodiment, the exhaust valve may include an exhaust valve diaphragm arranged to allow venting of the interior of the housing when a pressure in the interior of the housing is greater than an ambient pressure.

In a detailed embodiment, the second stage regulator valve assembly may be operatively coupled to the actuator; the second stage regulator valve assembly may be operative to selectively admit the pressurized gas to the interior of the housing in response to a first sensed pressure difference when the actuator is in the first position; and the second stage regulator valve assembly may be operative to selectively admit the pressurized gas to the interior of the housing in response to a second sensed pressure difference when the actuator is in the second position.

In a detailed embodiment, the second stage regulator valve assembly may include a secondary tension lever arm operative to select between the first sensed pressure difference and the second sensed pressure difference, and the actuator may act upon the secondary tension lever arm.

In a detailed embodiment, the second stage regulator valve assembly may include a regulator inlet valve fluidicly interposing the source of pressurized gas and the interior of the housing, a first spring arranged to bias the regulator inlet valve shut, and a second spring arranged to selectively bias the regulator inlet valve shut. In a detailed embodiment, the secondary tension lever arm may selectively engage the second spring to bias the regulator inlet valve shut.

In a detailed embodiment, the rebreather may be a closed circuit rebreather.

In an aspect, a mouthpiece supply valve may include a housing including a mouthpiece and having an interior; a one-way exhaust valve mounted to the housing and arranged to vent the interior of the housing to an ambient environment; an overpressure valve selectively fluidicly interposing the interior of the housing and the exhaust valve; a pressurized gas supply regulator mounted to the housing and arranged to selectively supply a pressurized gas to the interior of the housing; an inlet-outlet valve assembly mounted within the housing, the inlet-outlet valve assembly including a valve rod having a first end and a second end, a one-way inlet valve mounted to the first end of the valve rod, a one-way outlet valve mounted to the second end of the valve rod, and a spring arranged to bias the valve rod towards the second end; and an actuator operatively coupled to the valve rod and including a base portion, the base portion being arranged to selectively restrict and allow gas flow between the interior of the housing and the exhaust valve using the overpressure valve. In a detailed embodiment, the inlet-outlet valve assembly may be axially slidable within the housing between a first position and a second position, the first position being towards the first end and the second position being towards the second end. In a detailed embodiment, the housing may include at least one of a ring and a shoulder associated with each of the inlet valve and the outlet valve, the ring or shoulder being arranged to hold the respective valve shut when the inlet-outlet valve assembly is in the second position.

In a detailed embodiment, a mouthpiece supply valve may include a mode selector arranged to shift the inlet-outlet valve assembly between the first position and the second position. In a detailed embodiment, the mode selector may be arranged to simultaneously actuate the overpressure valve to restrict and allow gas flow between the interior of the housing and the exhaust valve.

In a detailed embodiment, a mouthpiece supply valve may include a spring-biased release rod, the mode selector may be coupled to the release rod, the actuator may be coupled to the release rod, and the valve rod may be coupled to the actuator.

In a detailed embodiment, the release rod and the valve rod may be arranged substantially in parallel.

In a detailed embodiment, the release rod may be biased towards its second position by a release rod spring, and the release rod spring may be operative to prevent the release rod from stopping in an intermediate position between the first position and the second position.

In a detailed embodiment, the overpressure valve may be spring-biased shut when the actuator is in the first position, and the actuator may maintain the overpressure valve open when the actuator is in the second position.

In a detailed embodiment, the mode selector may be manually operable to shift the inlet-outlet valve assembly between the first and second positions, and the mode selector may be automatically operable to shift the inlet-outlet valve assembly from the first position to the second position in response to a sensed condition. In a detailed embodiment, the sensed condition may be associated with at least one of a partial pressure of a constituent of the respiration gas, a pressure, a temperature, and a component failure.

In a detailed embodiment, a mouthpiece supply valve may include an automatic actuator, which may include at least one of a solenoid, a pneumatic actuator, a squib, a thermal retention device, and a piezo crystal actuator.

In a detailed embodiment, at least one of the inlet valve and the outlet valve may include a mushroom-type check valve.

In a detailed embodiment, the pressurized gas supply regulator may be manually actuatable via a button and automatically actuatable by a diaphragm.

In a detailed embodiment, the diaphragm may fluidicly interpose the interior of the housing and the ambient environment, the diaphragm may be operatively connected to a regulator inlet valve, and the diaphragm may be operative to open the regulator inlet valve when a differential pressure between the interior of the housing and the ambient environment exceeds a first setpoint when the actuator is in the first position. In a detailed embodiment, the diaphragm may be operative to open the regulator inlet valve when the differential pressure between the interior of the housing and the ambient environment exceeds a second setpoint when the actuator is in the second position.

In a detailed embodiment, the inlet valve and the outlet valve may be fluidicly connected to a rebreather.

In an aspect, a regulator valve assembly may include an inlet orifice fluidicly connected to a source of pressurized gas; an regulator valve arranged to selectively seal against the inlet orifice; a valve spring arranged to bias the regulator valve into sealing contact with the inlet orifice; a first valve actuator operatively coupled to the regulator valve for selectively opening the regulator valve; a secondary tension piston selectively engagable with the regulator valve; a secondary tension spring arranged to bias the secondary tension piston toward the regulator valve; a second valve actuator operatively coupled to the secondary tension piston for selectively engaging the secondary tension piston with the regulator valve. In a detailed embodiment, a first actuating force applied to the first valve actuator to open the regulator valve when the secondary tension piston is disengaged from the regulator valve is less than a second actuating force applied to the first valve actuator to open the regulator valve when the secondary tension piston is engaged with the regulator valve.

In a detailed embodiment, the first valve actuator may include a first pivotable lever arm.

In a detailed embodiment, the second valve actuator may include a second pivotable lever arm.

In a detailed embodiment, a regulator valve assembly may include a diaphragm arranged to sense a differential pressure, the diaphragm being operatively connected to the first valve actuator.

In a detailed embodiment, the inlet orifice, the regulator valve, and the secondary tension piston may be linearly arranged.

In a detailed embodiment, a regulator valve assembly may include a valve spring adjustment boot mechanically interposing the second valve actuator and the secondary tension piston. In a detailed embodiment, movement valve spring adjustment boot in response to movement of the second valve actuator is operative to engage and disengage the secondary valve piston from the regulator valve.

In a detailed embodiment, the first valve spring may mechanically interpose the valve spring adjustment boot and the regulator valve, and movement of the valve spring adjustment boot towards the orifice may press the first valve spring towards the regulator valve and permits engagement of the secondary tension piston with the regulator valve.

In a detailed embodiment, a regulator valve assembly may include an adjustment knob threadedly engaged with the valve spring adjustment boot, the adjustment knob being operative to compress the secondary tension spring.

In an aspect, a mouthpiece supply valve control system may include at least one sensor operative to produce a sensor signal associated with a sensed condition; at least one computer operatively connected to the at least one sensor for producing a computer signal associated with the sensor signal; a logic device operatively connected to the at least one computer for receiving the computer signal; and an automatic actuator operatively connected to the logic device. The automatic actuator may be operatively coupled to a mouthpiece supply valve, the mouthpiece supply valve being selectable between at least a first mode and a second mode. The automatic actuator may be operative to shift the mouthpiece supply valve from the second mode to the first mode upon receipt of a logic device signal from the logic device.

In a detailed embodiment, the automatic actuator may include at least one of a solenoid, a pneumatic actuator, a squib, a thermal retention device, and a piezo crystal actuator.

In a detailed embodiment, the sensed condition may be associated with at least one of a partial pressure of a constituent of the respiration gas, a pressure, a temperature, and a component failure.

In a detailed embodiment, the logic device may include a watchdog timer, and the computer signal may include a reset signal when the sensor signal is associated with a normal condition.

In a detailed embodiment, the at least one computer may include at least two computers, and the at least one sensor may include at least one sensor associated with each of the at least two computers.

In a detailed embodiment, the at least one sensor may include a plurality of sensors, the plurality of sensors being associated with a respective plurality of computers, the plurality of computers being operative to provide respective computer signals to the logic device, and the logic device may produce the logic device signal based at least partially upon the computer signals received from the plurality of computers.

In a detailed embodiment, the logic device may be programmed to disregard computer signals associated with computers that are determined to be inoperative.

BRIEF DESCRIPTION OF THE DRAWINGS

The detailed description refers to the following figures in which.

DETAILED DESCRIPTION OF THE INVENTION

The present disclosure is direct to self-contained breathing apparatus and, more particularly, to mouthpiece supply valves for use with rebreather-type self-contained breathing apparatus. Exemplary embodiments may include a multi-function mouthpiece supply valve (also referred to as a dive/surface valve (DSV)) which provides respiration gas from a gas mixing and cleaning apparatus to a user in a rebreather mode (also referred to as SCR/CCR mode). An exemplary mouthpiece supply valve may also be operable in a bail out mode (also referred to as BOV mode) in which the user is provided with respiration gas from an external source (such as a compressed gas cylinder) via a BOV. Exemplary embodiments may be useful in applications such as fire fighting, medical oxygen delivery, personnel isolation suits for hazardous environments, mine safety emergency gas supply systems, aviation gas supply systems, underwater breathing devices, and other applications.

Figure 1:
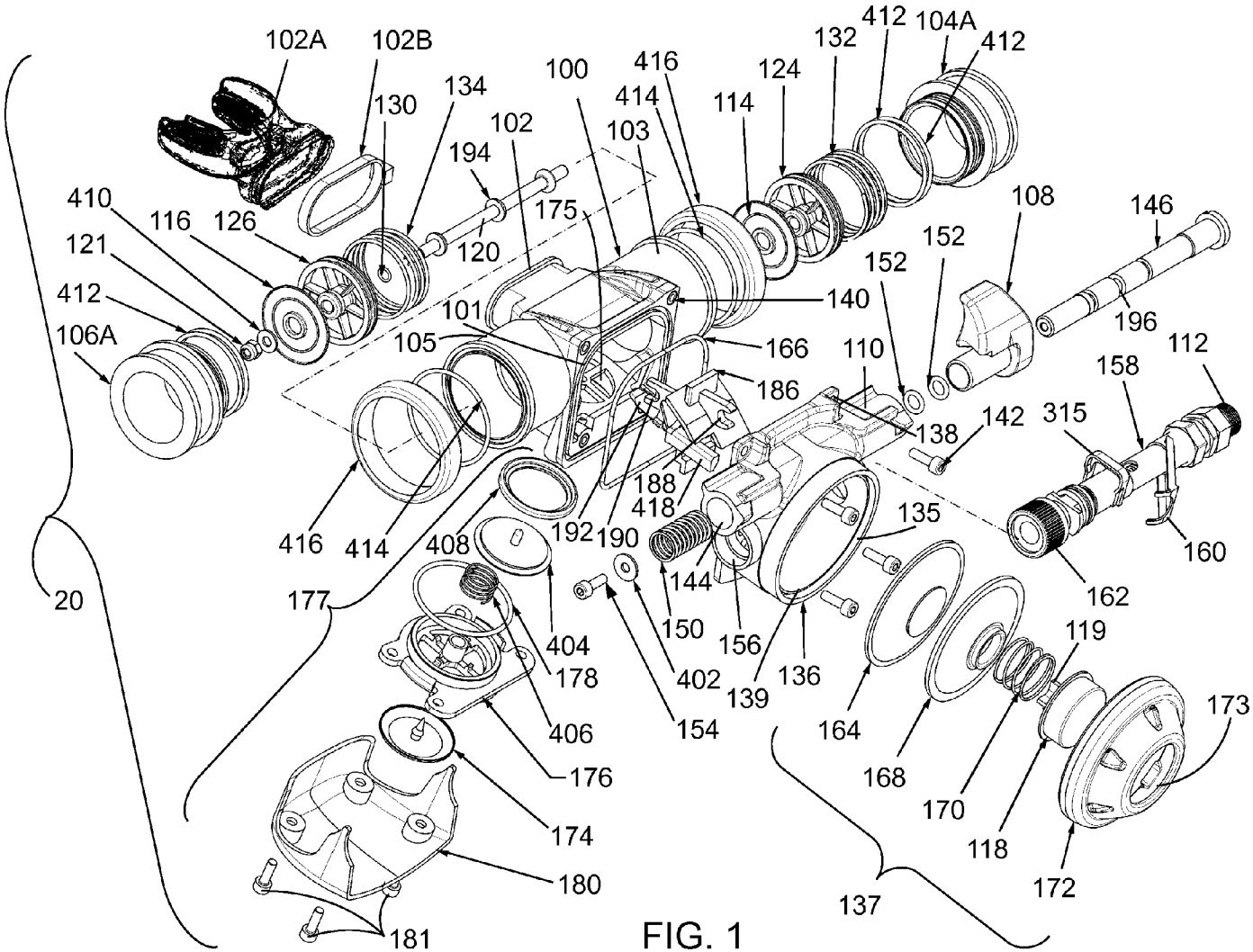
FIG. 1 is an exploded view of an exemplary mouthpiece supply valve.

Referring to FIG. 1, an exemplary mouthpiece supply valve 20 may include a main housing 100, which may structurally support various other components. The main housing 100 may include a mouthpiece connector 102, which may receive a compliant mouthpiece 102A (which may be made of silicone, rubber, or another soft material, for example) which may be retained by a polymer tension band 102B (or other clamping device), for example. The mouthpiece may be held in a user's mouth.

The main housing 100 further may include a forward opening port 101 for seating the valve housing 136 and its associated assemblies as described below, and may further include opposed, cylindrical inlet and outlet ports, 103 and 105, extending out opposite sides of the main housing 100 and coaxially aligned with each other.

Figure 14:
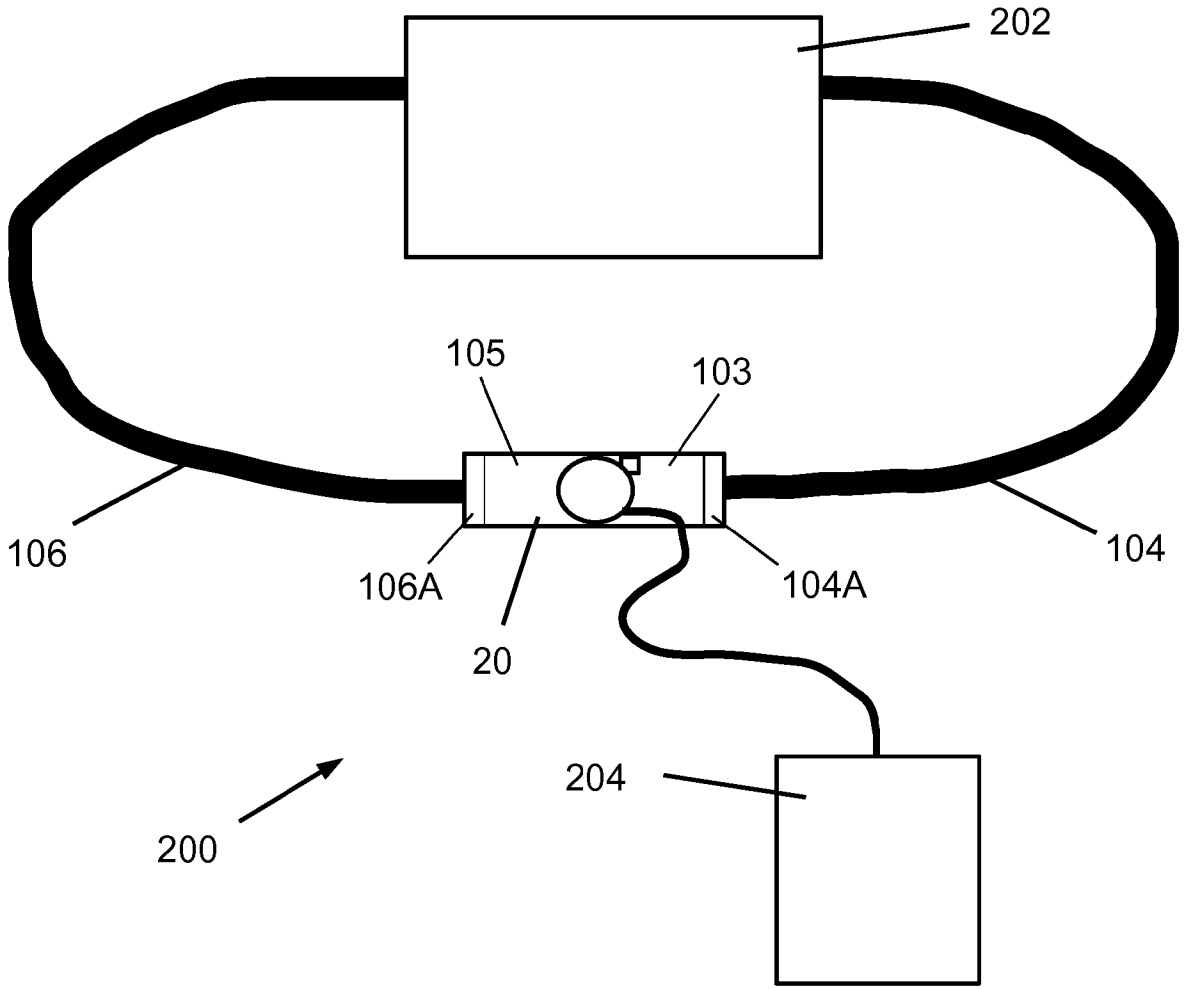
FIG. 14 is a schematic diagram of an exemplary mouthpiece supply valve installed in an exemplary rebreather system.

As shown in FIG. 14 with reference to an exemplary self-contained breathing apparatus 200, inlet tubing 104 and/or outlet tubing 106, respectively coupled to inlet port 103 and outlet port 105, may connect a mouthpiece supply valve 20 to a rebreather 202 (via inlet hose connector 104A and outlet hose connector 106A), which may include various gas renovation components operative to render an exhaled gas suitable for inhalation.

Referring to FIGS. 1 and 14, in an exemplary embodiment, inlet hose connector 104A and/or outlet hose connector 106A, respectively provided on inlet port 103 and outlet port 105, may be sealed to other components, such as inlet tubing 104 and/or outlet tubing 106, using one or more hose connector clamps 416 and/or one or more o-rings 412, 414. As discussed below, in rebreather mode, inlet tubing 104 may provide respiration gas to the mouthpiece for inhalation by the user, and outlet tubing 106 may receive exhaled respiration gas from the user via the mouthpiece. An exemplary self-contained breathing apparatus 200 may further include a compressed gas cylinder 204 (or other source of compressed gas), which may be connected to an exemplary mouthpiece supply valve 20.

Referring back to FIG. 1, in an exemplary embodiment, inlet hose connector 104A and outlet hose connector 106A may include mounting surfaces sized to receive inlet tubing and/or outlet tubing provided with a variety of different rebreather devices, such as those provided by different manufacturers. For example, inlet hose connector 104A and outlet hose connector 106A may include mounting surfaces having appropriate sizes, shapes, thread configurations, etc. to couple with different rebreather devices.

Figure 2:
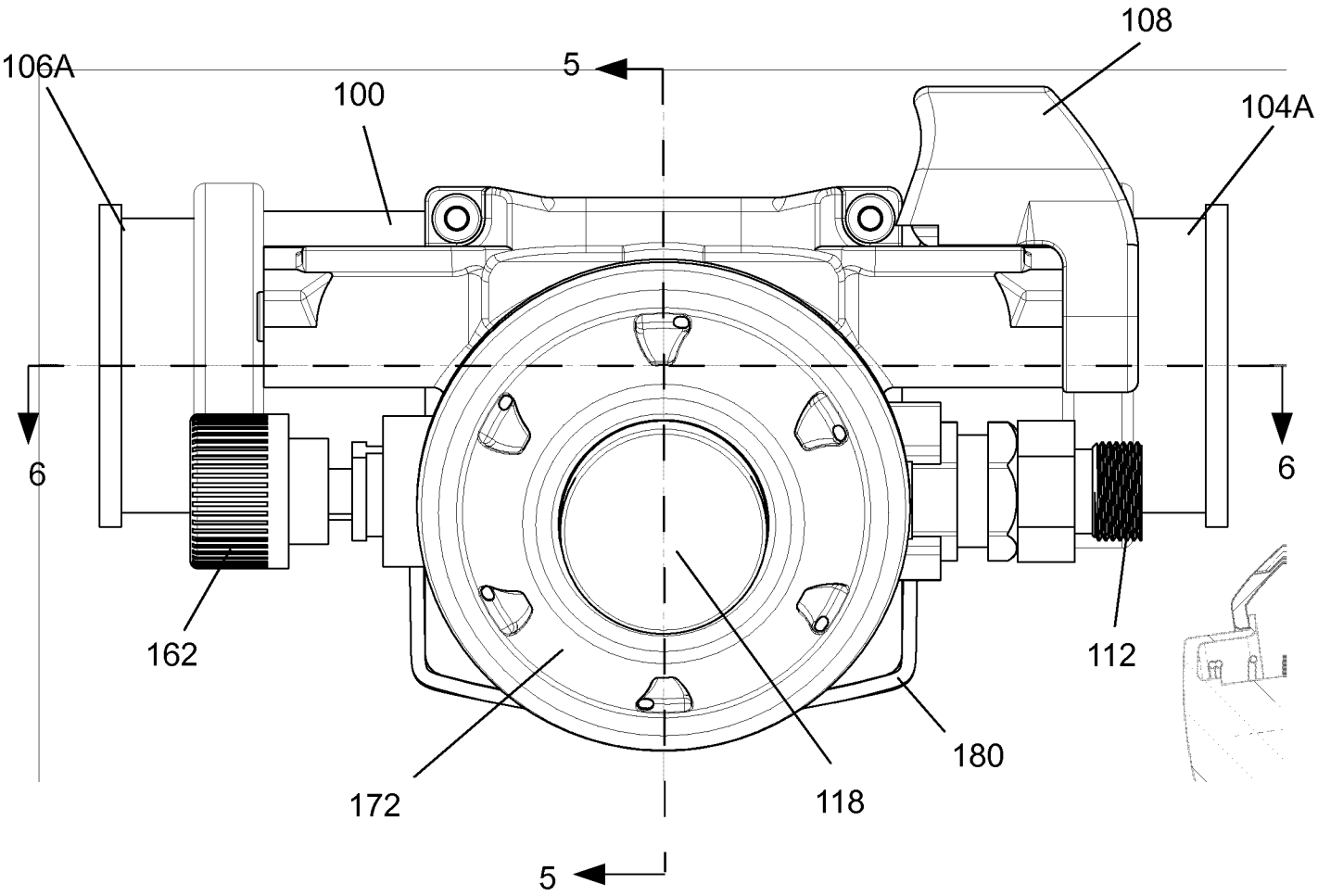
FIG. 2 is a front elevation view of an exemplary mouthpiece supply valve.
Figure 3:
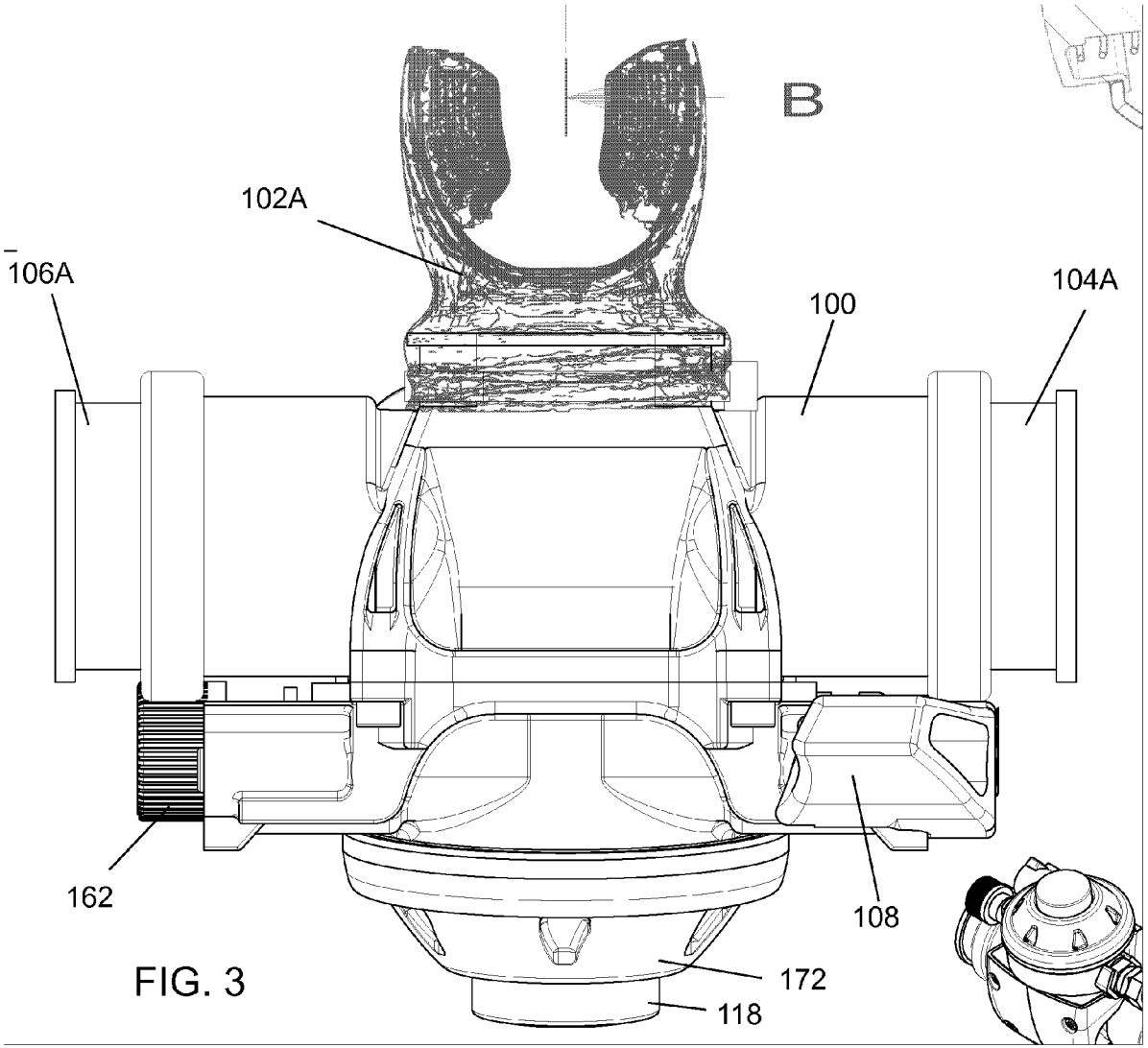
FIG. 3 is a plan view of an exemplary mouthpiece supply valve.
Figure 4:
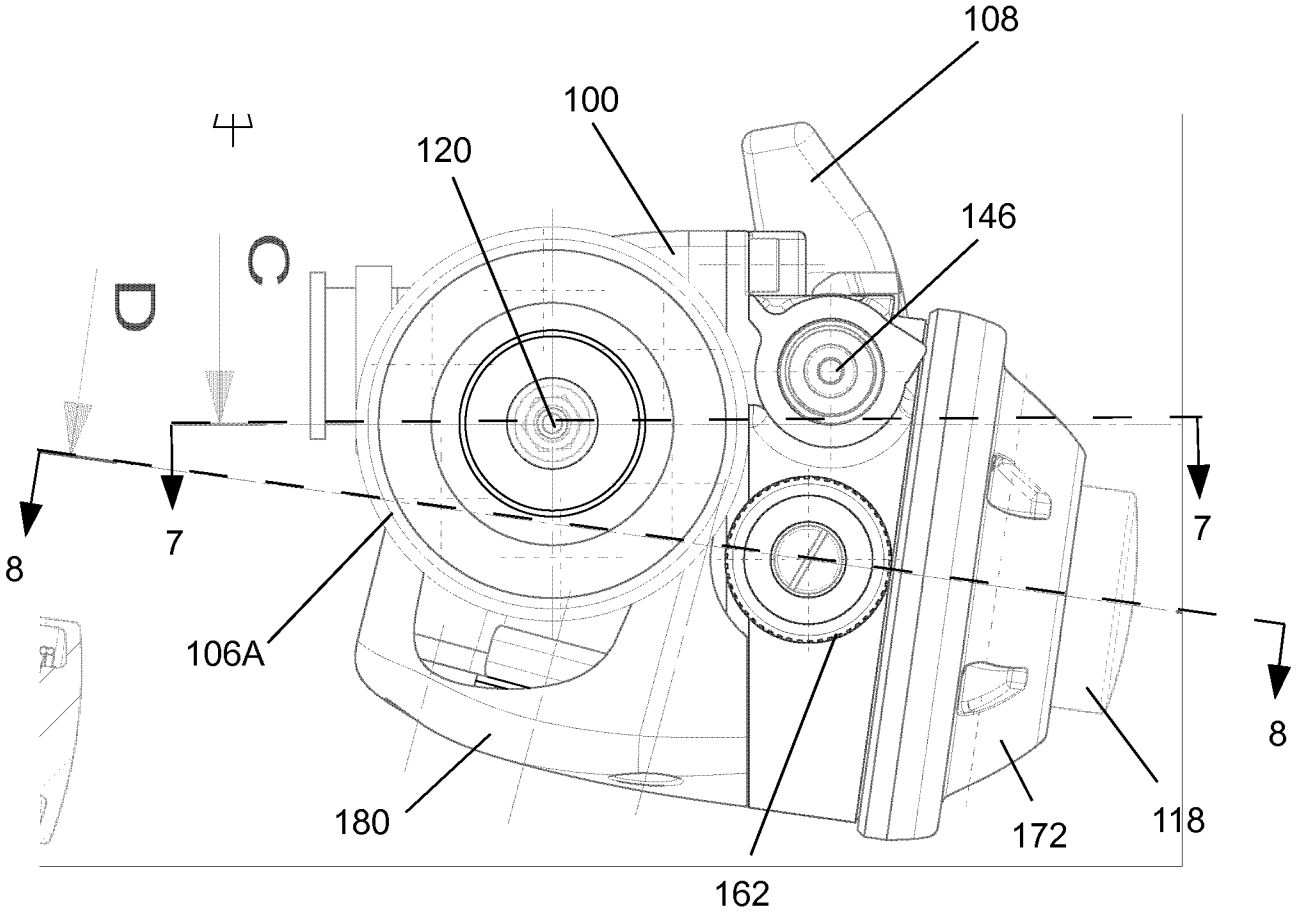
FIG. 4 is a left elevation view of an exemplary mouthpiece supply valve.
Figure 5:
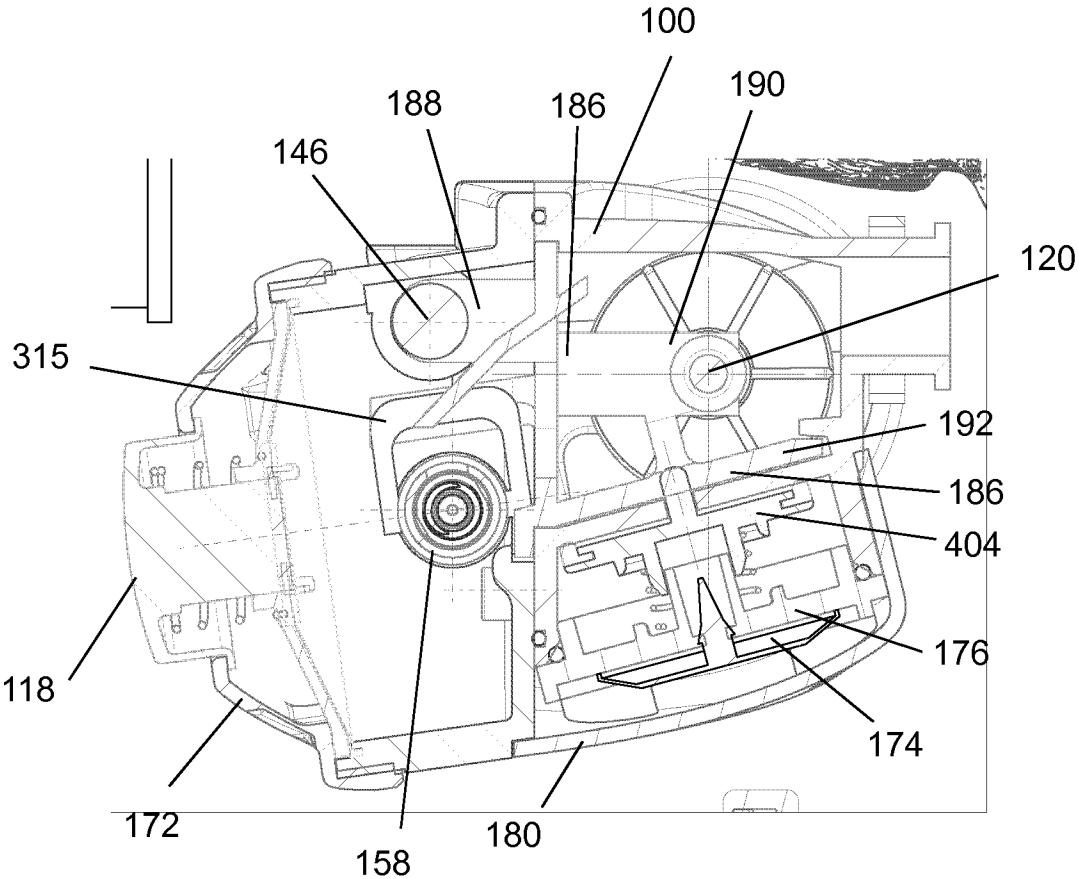
FIG. 5 is cross-sectional view along line 5-5 in FIG. 2.

Referring primarily to FIGS. 1-3, in an exemplary embodiment, a mode selector 108 (also referred to as a "BOV button"), provided on valve housing 136, may switch the mouthpiece supply valve 20 between rebreather mode and bail out mode. In bail out mode (the mode illustrated in FIGS. 2 and 3), a portion of mode selector 108 may engage slot 110 provided on the valve housing 136. A user may shift from bail out mode to rebreather mode by extending the mode selector out of the slot 110 and then rotating mode selector 108 downwardly. From the perspective of a user who may be holding a mouthpiece attached to mouthpiece connector 102 in his or her mouth, shifting from bail out mode to rebreather mode may require pulling mode selector 108 to the left (out of slot 110) and rotating it downward. Similarly, a user may shift from rebreather mode to bail out mode by rotating mode selector 108 upwardly towards slot 110. As discussed below, a spring associated with mode selector 108 may be arranged to pull mode selector 108 into engagement with slot 110 once mode selector 108 is substantially aligned by rotation with slot 110. In some exemplary embodiments, mode selector 108 may be mounted on the other side of mouthpiece supply valve 20 for operation by a user's right hand.

In an exemplary embodiment, an external connection 112 (provided on a regulator valve assembly 158 mounted to and extending through the valve housing 136) may be utilized to connect mouthpiece supply valve 20 to an external source of respiration gas, such a compressed gas cylinder 204 (see FIG. 14). As will be described in detail below, a purge button 118 provided on valve housing 136 and mechanically linked to lever arm 160 on the regulator valve assembly 158 may be used to actuate the lever arm 160 on the regulator valve assembly 158, thus manually causing flow from the external source of respiration gas into the mouthpiece supply valve 20.

An exemplary mouthpiece supply valve 20 may include two mushroom-type check valves, inlet mushroom valve 114 and outlet mushroom valve 116, respectfully mounted within the inlet and outlet ports 103, 105 of housing 100, in series, with the mouthpiece connection 102 fluidicly between them. Mushroom valves 114, 116 may be mounted within main housing 100 on rod 120 which extends axially between the inlet and outlet ports 103, and 105 and through the center of the housing 100. Mushroom valve 114 allows gas flow into the main housing through the inlet port, but does not allow gas flow in the opposite direction; while mushroom valve 116 allows gas flow out from the main housing through the outlet port, but does not allow gas flow in the opposite direction. Spiders 124, 126 (also referred to as mushroom valve membrane retainers) may be mounted to rod 120 against mushroom valves 114, 116, respectively on the upstream side of such mushroom valves. Spiders 124, 126 may be operative to prevent mushroom valves 114, 116 from collapsing in a counterflow direction. In addition, spiders 124, 126 may be operative to hold mushroom valves 124, 126 shut when the mouthpiece supply valve 20 is placed in bail out mode. Also associated with mushroom valves 114, 116 may be one or more o-rings 130 (which may seal the hubs of spider 126 to rod 120) and/or one or more mushroom valve tensioning springs 132, 134 that may respectively mounted within the ports 103, 105, to bias spiders 124, 126 towards mushroom valves 114, 116, which may aid in shutting mushroom valves 114, 116 in bail out mode and/or may assist in switching the mouthpiece supply valve 20 into bail out mode from rebreather mode. Nut 121 and/or waster 410 may be threaded onto rod 120 to retain spider 126.

Figure 6:
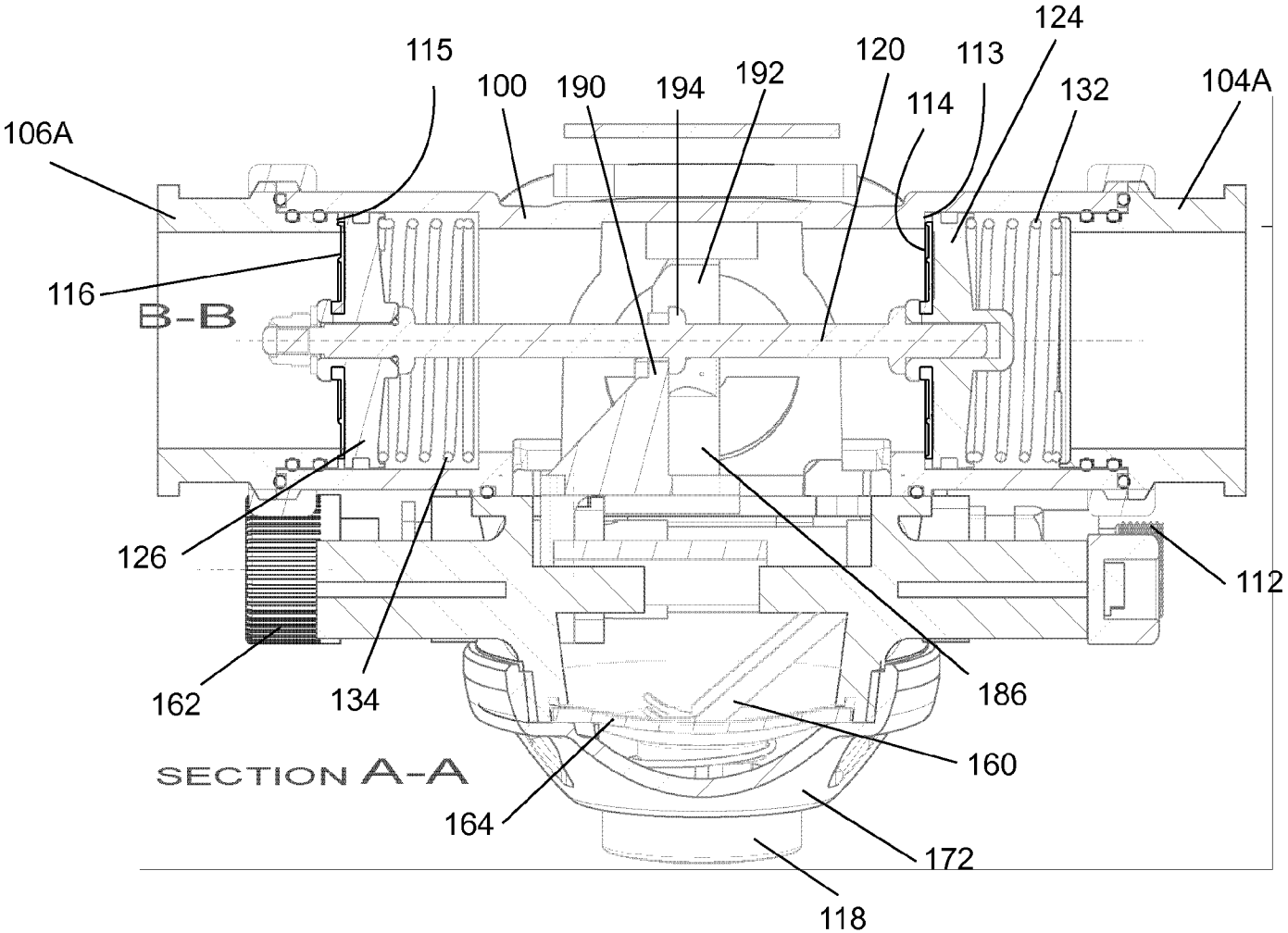
FIG. 6 is a cross-sectional view along line 6-6 in FIG. 2.

In an exemplary embodiment, as shown in FIG. 6, one or more internal shoulders 113, 115, may be provided near inlet mushroom valve 114 and/or outlet mushroom valve 116 such that the respective spiders 124, 126 may press the respective mushroom valves 114, 116 against the respective shoulders to maintain the mushroom valves 114, 116 shut in certain circumstances as described below. For example, main housing 100 may include an internal shoulder 113, near inlet mushroom valve 114, and outlet hose connector 106A may include an internal shoulder 115 near outlet mushroom valve 116.

Referring again to FIG. 1, in an exemplary embodiment, a valve housing 136 may be mounted to forward opening port 101 of main housing 100. One or more holes 138 through valve housing 136 may align with one or more holes 140 in main housing 100, which may be adapted to receive one or more screws 142. O-ring 166 may facilitate a sealed interface between valve housing 136 and the forward opening port 101 main housing 100.

Valve housing 136 may include a first lateral passage 144 extending therethrough, which may be adapted to receive a BOV release rod 146. BOV release rod 146 may be axially slidable within first lateral passage 144 using mode selector 108, which may be concentrically mounted thereto. BOV release rod 146 may be adapted to receive BOV spring 150, one or more o-rings 152 (which may prevent fluid ingress into valve housing 136), mode selector 108, BOV screw 154, and BOV washer 402. BOV spring 150 may be operative to assist in shifting rod 120 and BOV release rod 146 between rebreather and bail out modes as discussed below, and BOV spring 150 may prevent BOV release rod from stopping at an intermediate position between its rebreather mode position and its bail out mode position.

An exemplary valve housing 136 may include a second lateral passage 156 below the first lateral passage 144, which may be adapted to receive a second stage regulator valve assembly 158. Second stage regulator valve assembly 158 may receive pressurized gas from an external source via external connection 112, and second stage regulator valve assembly 158 may include a lever arm 160 (which may be operatively connected to an internal valve assembly) and an adjustment knob 162. In an exemplary embodiment, a high pressure reduction regulator (first stage regulator) may interpose the external source of gas and external connection 112 and may reduce the supplied gas pressure to approximately 150 psi above ambient pressure, for example. Second stage regulator valve assembly 158 may be operative to further reduce the externally supplied gas pressure to approximately ambient pressure, and second stage regulator valve assembly 158 may be adjusted using adjustment knob 162. In an exemplary embodiment, second stage regulator valve assembly 158 may include a dual tension second stage regulator as described below.

An exemplary valve housing 136 may have a forward opening/mount 135 adapted to receive a purge button assembly 137 (which may act upon lever arm 160 of second stage regulator valve assembly 158), where the purge button assembly 137 includes, in nested construction, a diaphragm 164 positioned on an annular shoulder 139 circumscribing the forward opening/mount 135, front plate 168 positioned on the annular shoulder 139 over the diaphragm, purge button 118 positioned over the front plate 168 and including an actuator projection 119 extending through the open hub of the front plate 168 and contacting diaphragm 164, purge button spring 170 positioned between the purge button 118 and front plate 168 (which may bias purge button 118 in a direction generally away from mouthpiece connector 102), and/or diaphragm lid 172 mounted thereover to the valve housing. The purge button 118 presses against diaphragm 164, which in turn presses against lever arm 160. The diaphragm lid 172 includes a central opening 173 through which the purge button 118 extends. Front plate 168 may be arranged to prevent water from directly hitting diaphragm 164, which otherwise may cause second stage regulator valve assembly 158 to supply unnecessary gas into main housing 100 in an uncontrolled manner (e.g., free flow). In particular, front plate 168 may assist in preventing hydrostatic imbalances from impacting proper operation of the diaphragm 164 and second stage regulator valve assembly 158. Diaphragm lid 172 may partially cover and may hold purge button 118, purge button spring 170, front plate 168, and diaphragm 164 in place on valve housing 136.

An exemplary main housing 100 may include a bottom opening 175 adapted to seat an exhaust valve assembly 177. The exhaust valve assembly 177 may include an exhaust diaphragm 174, which may be mounted to an exhaust valve retainer 176, which is mounted over the bottom opening 175 of the main housing. Exhaust diaphragm 174 may be arranged to allow fluid (such as saliva from the user and/or fluid which has entered the loop from outside, such as sea water) and/or gas to exit from the interior of main housing 100, and may prevent gas and/or fluid in the ambient environment from entering main housing 100. Exhaust valve retainer 176 may be sealed to main housing 100 by o-ring 178, and may be covered by exhaust cover 180. Screws 181 extend through corresponding holes in the exhaust cover, exhaust valve retainer 176 and main housing 100 to fasten the exhaust valve assembly 177 over the bottom opening 175 of the main housing 100. Exhaust valve retainer 176 may include openings to allow fluid and/or gas from the interior of main housing 100 to exit via exhaust diaphragm 174, and exhaust valve retainer 176 may substantially support and provide a seating surface for exhaust diaphragm 174. Exhaust cover 180 may be arranged to direct exhaust received from exhaust diaphragm 174 toward the sides (e.g., generally beneath inlet hose connector 104A and outlet hose connector 106A).

In an exemplary embodiment, exhaust valve retainer 176 may also support an overpressure valve plate 404 and overpressure valve spring 406. An overpressure sealing ring 408 may be mounted to the overpressure valve plate 404, and overpressure valve spring 406 may be arranged to bias overpressure valve plate 404 and overpressure sealing ring 408 into sealed contact with the portion of exhaust valve retainer 176 around bottom opening 175. Exemplary operations of the overpressure valve components are described below.

An exemplary mouthpiece supply valve 20 may include an actuator 186. In an exemplary embodiment, actuator 186 may be adapted to perform several functions and may include several components, such as a first engagement portion 188 (which may be adapted to engage a groove 196 on BOV release rod 146), a second engagement portion 190 (which may be adapted to engage a boss 194 on rod 120), a base portion 192 (which may be adapted to selectively open overpressure valve plate 404), and/or an extension 418 (which may be arranged to selectively act upon secondary tension lever 315 of second stage regulator valve assembly 158 to vary the setpoint of the regulator as described below).

An exemplary mouthpiece supply valve 20 may be shifted between rebreather and bail out. In rebreather mode, mode selector 108 is in its rotated and extended position. This retains BOV release rod 146 in its rebreather position (towards inlet port 103). Slot 196 on BOV release rod 146 holds actuator 186 in its rebreather position (towards inlet port 103). Engagement portion 190 of actuator 186 holds valve rod 120 in its rebreather position (towards inlet port 103), which holds inlet and outlet mushroom valves 114, 116 away from shoulders 113, 115, respectively. Thus, inlet and outlet mushroom valves 114, 116 may function as one-way valves as discussed above. In addition, base portion 192 of actuator 186 is disengaged from overpressure plate 404; thus, overpressure plate 404 is shut by overpressure plate spring 406. In addition, extension 418 of actuator 186 holds secondary tension lever arm 315 towards adjustment knob 162, thereby increasing the differential pressure setpoint of secondary regulator valve assembly 158 as discussed below.

An exemplary mouthpiece supply valve 20 may be shifted into bail out mode from rebreather mode by rotating mode selector into alignment with slot 110. BOV release rod spring 150 pulls BOV release rod 146 into its bail out position (towards outlet port 105). Slot 196 on BOV release rod 146 pulls actuator 186 into its bail out position (towards outlet port 105). Engagement portion 190 of actuator 186 pulls valve rod 120 into its bail out position (towards outlet port 105), which holds inlet and outlet mushroom valves 114, 116 against shoulders 113, 115, respectively, which maintains them shut. In addition, base portion 192 of actuator engages overpressure plate 404, overcoming the force of overpressure plate spring 406 and opening overpressure plate 404. This fluidicly connects exhaust valve diaphragm 174 and the interior of the main housing 100. In addition, extension 418 of actuator 186 allows secondary tension lever arm 315 to return to its generally perpendicular initial position, which decreases the differential pressure setpoint for secondary regulator valve assembly 158 as discussed below. Shifting from bail out mode into rebreather mode occurs in the same manner, but in the opposite direction as mode selector 108 is extended and rotated downward, thereby shifting actuator 186 into the rebreather position as described in the previous paragraph.

In an exemplary embodiment, a mouthpiece supply valve 20 may be prevented from partially shifting between rebreather mode and bail out mode. For example, BOV release rod spring 150 may bias BOV release rod 146 sufficiently that unless mode selector 108 is "latched" in the rebreather position, BOV release rod spring 150 may press BOV release rod 146 (and actuator 186 and valve rod 120) into the bail out position. Similarly, once mode selector 108 is positively latched in the rebreather position, actuator 186 and valve rod 120 may be fully shifted to their respective rebreather positions.

In some exemplary embodiments, a rotary or barrel type shut-off valve may be incorporated in main housing 100 to prevent outside gas or fluid from entering the respiration loop if the user removes the mouthpiece valve from the mouth or otherwise breaks the loop's seal.

Figure 11:
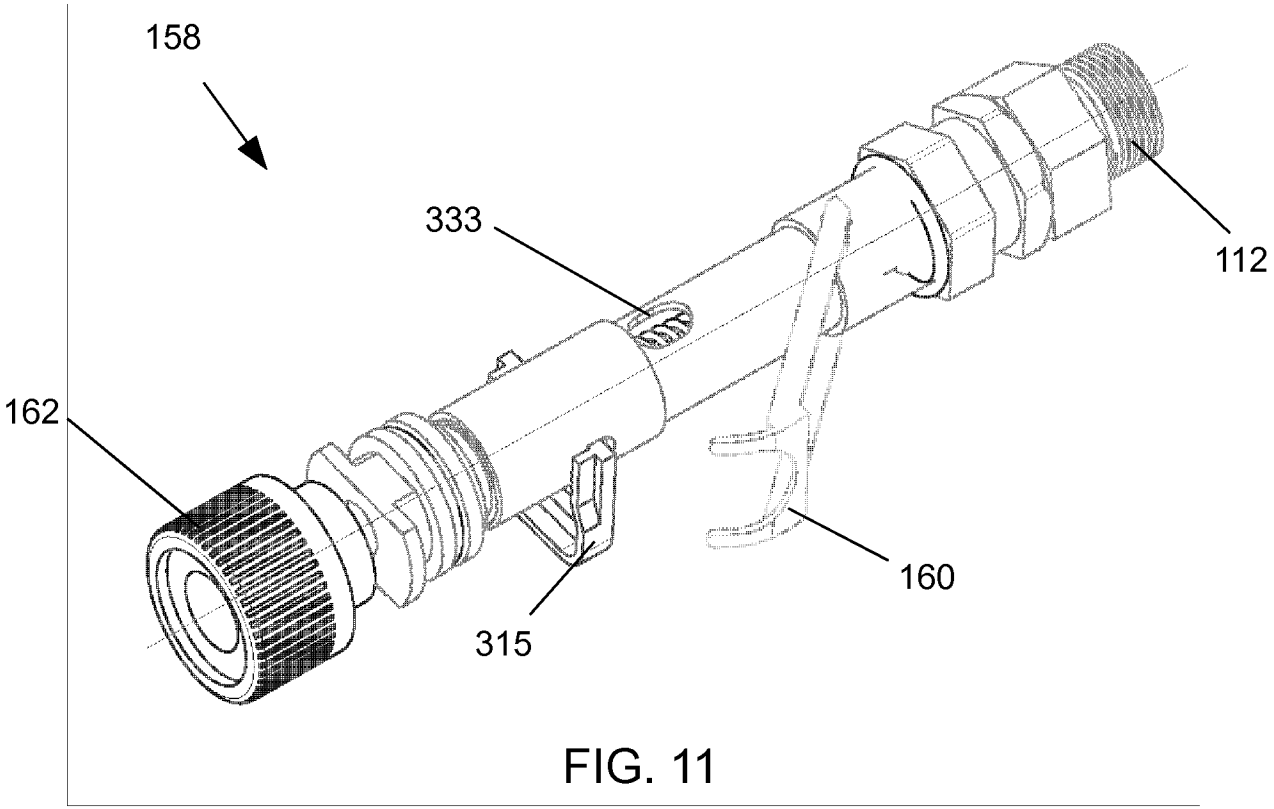
FIG. 11 is a perspective view of an exemplary second stage regulator valve assembly.
Figure 12:
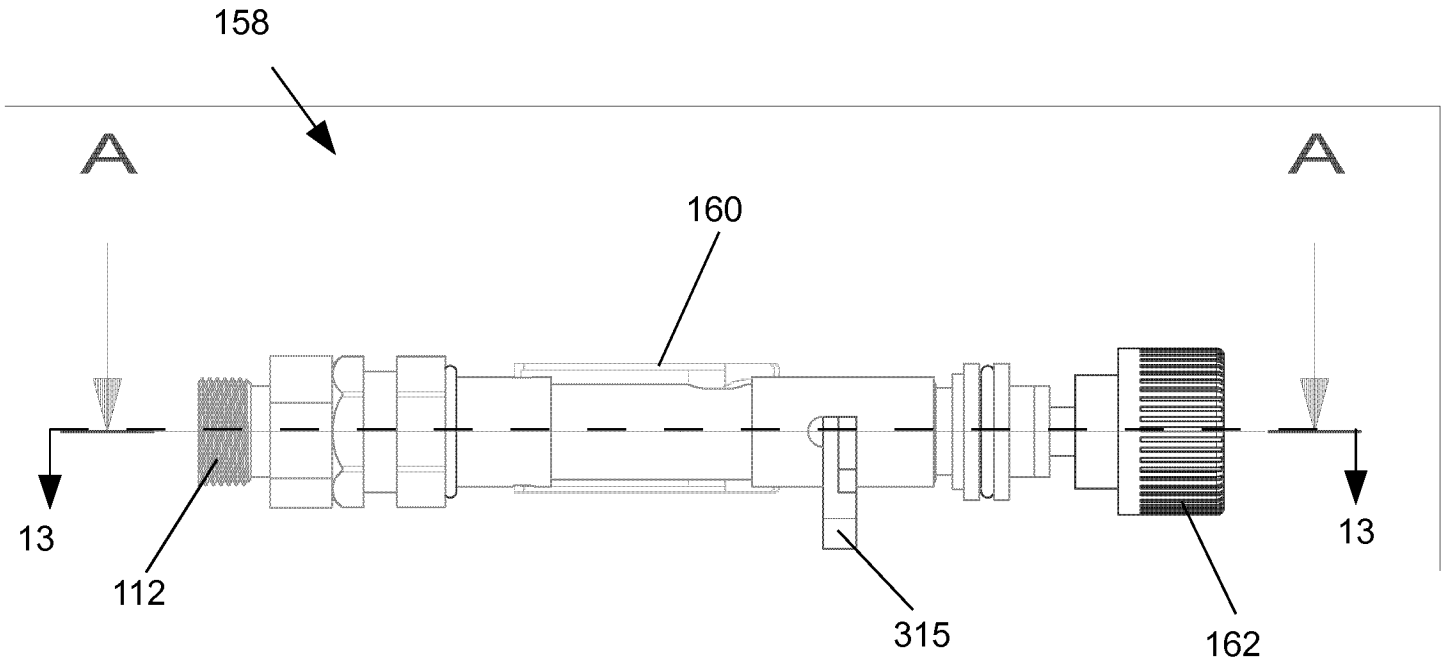
FIG. 12 is an elevation view of an exemplary second stage regulator valve assembly.
Figure 13:
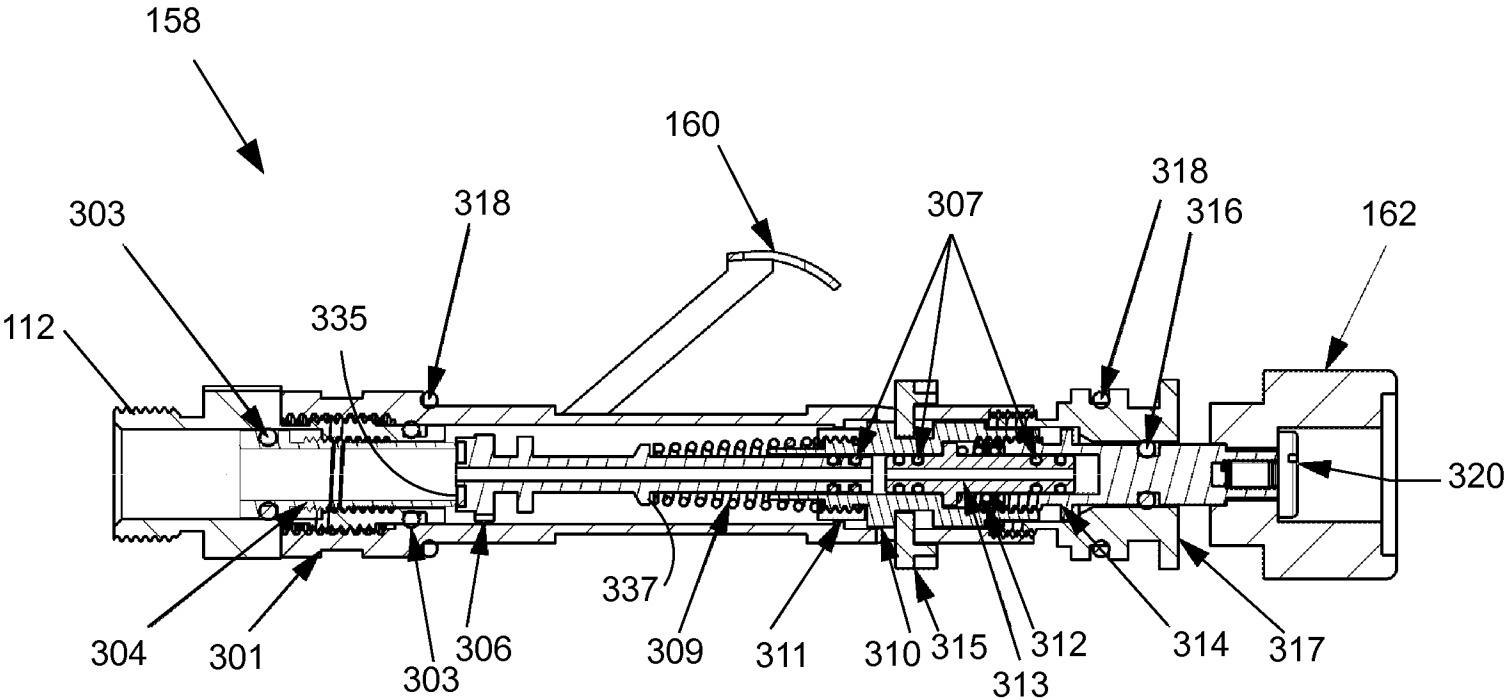
FIG. 13 is a cross-sectional view along line 13-13 in FIG. 12.

FIGS. 11-13 depict an exemplary dual tension second stage regulator valve assembly 158. Regulator valve housing 301, which may be substantially cylindrical as shown in the Figures including an external connection 112 on one end and adjustment knob 162 on the other. The regulator valve housing 301 may provide a framework and structure to hold various regulator components, and may include one or more side openings 333 (see FIG. 11) allowing pressurized gas to exit the regulator valve housing 301 into the interior of the mouthpiece supply valve main housing 100. External connection 112 may be coupled to a hose connected to a high pressure gas cylinder via a high pressure regulator reducing device (e.g., a first stage regulator) which may provide pressurized gas at a pressure of about 150 psi above ambient. External connection 112 may be threadedly joined to regulator valve housing 301, and an o-ring 303 my provide a sealed interface.

In an exemplary embodiment, an orifice 304 may be mounted within the external connection 112. In an exemplary embodiment, the axial position of the orifice 304 may be threadedly adjustable allowing for tuning of the second stage regulator valve assembly 158.

In an exemplary embodiment, regulator inlet valve 306 is a biased piston-type valve and may include a soft seating end surface 335 on the end facing towards and selectively engaging the orifice 304 opening. Regulator inlet valve 306 may be mechanically coupled to lever arm 160 such that regulator inlet valve 306 moves longitudinally away from orifice 104 (to the right in FIG. 13) when the lever arm 160 is depressed (towards regulator valve housing 301), thereby allowing pressurized gas to enter the regulator valve housing 301. When lever arm 160 returns to its initial position, regulator inlet valve 306 returns to its position against orifice 304, thereby terminating pressurized gas flow from the high pressure gas cylinder.

An exemplary embodiment may include a valve spring 309 coaxially mounted over the inlet valve 306 between annular shoulder 337 extending from the reciprocating valve body and an adjustment nut 311 provided within the regulator valve housing 301 distal from the shoulder 337 with respect to the orifice 304. The valve spring may be a compression spring arranged to bias regulator inlet valve 306 towards orifice 304. Valve spring 309 may be operative to seal regulator inlet valve 306 against orifice 304 and to bias lever arm 160 outward into its initial position. The valve spring adjustment nut 311 may threadedly engage valve spring adjustment boot 310, and may allow adjustment of the force exerted by valve spring 309.

In an exemplary embodiment, valve spring adjustment boot 310 may slidably receive the end of regulator inlet valve 306 opposite the end that selectively engages orifice 304. In addition, valve spring adjustment boot 310 may receive secondary tension piston 313 and secondary tension spring 312 in a coaxially distal position with respect to the inlet valve. Further, a groove on an outer surface of valve spring adjustment boot 310 may receive portions of secondary tension lever arm 315. In a position generally perpendicular the axis of regulator valve housing 301, secondary tension lever arm 315 does not inhibit the motion of regulator inlet valve 306 due to movement of lever arm 160. However, when secondary tension lever arm 315 is pivoted to either side, it moves valve spring adjustment boot 310 and secondary tension piston 313 axially into contact with regulator inlet valve 306. This increases the force that must be applied to lever arm 160 to cause regulator inlet valve 306 to move away from orifice 304 to admit pressurized gas into mouthpiece supply valve main housing 100. Thus, by moving secondary tension lever arm 315 to an actuated position, a greater differential pressure must be felt on diaphragm 164 to cause movement of lever arm 160 and admission of pressurized gas.

Referring back to FIG. 1, in an exemplary mouthpiece supply valve, extension 418 of actuator 186 may be arranged to move secondary tension lever arm 315 to the side (towards external connection 112) when the mouthpiece supply valve 20 is placed in the rebreather mode, and actuator 186 may be arranged to allow secondary tension lever arm 315 to return to its substantially perpendicular initial position when the mouthpiece supply valve 20 is placed in the bail-out mode.

Referring back to FIGS. 11-13, in an exemplary embodiment, a secondary tension adjustment screw 314 may seat a distal end of the secondary tension piston 313 and a distal end of secondary tension spring 312. Secondary tension adjustment screw 314 may be threadedly adjustable (axially adjustable) to vary the additional force applied by secondary tension spring 312 on regulator inlet valve 306, thereby allowing adjustment of the increase in differential pressure that must be felt by diaphragm 164 for secondary regulator valve assembly 158 to admit pressurized gas into the mouthpiece supply valve main housing 100.

In an exemplary embodiment, an adjust cap screw 317 may threadedly engage regulator valve housing 301 and may be operative to hold various internal parts in place.

In an exemplary embodiment, an adjustment knob 162 may attach to the end of the secondary tension adjustment screw 314 and may facilitate manual adjustment of the secondary tension adjustment screw 314 as discussed above. Adjustment knob 162 may be affixed to secondary tension adjustment screw 314 by an adjustment knob screw 320.

In an exemplary embodiment, various o-rings 303, 307, 316, 318 may provide sealed interfaces between various components. O-rings 318 may be provided on external surfaces of secondary regulator valve assembly 158 and may be operative to seal secondary regulator valve assembly 158 to mouthpiece supply valve main housing 100.

Although an exemplary secondary regulator valve assembly 158 has been described in connection with a rebreather mouthpiece supply valve, it is to be understood that the exemplary secondary regulator valve assembly 158 may be utilized in other devices. For example, an exemplary secondary regulator valve assembly 158 as described herein may be useful in open circuit regulator second stages, particularly with octopus alternate air sources or stage cylinder regulators. Exemplary embodiments may reduce the possibility of free flow failures and a consequent loss of gas supply. More generally, an exemplary secondary regulator valve assembly 158 as described herein may be useful where it is desirable to toggle a regulator between two setpoints.

Figure 7:
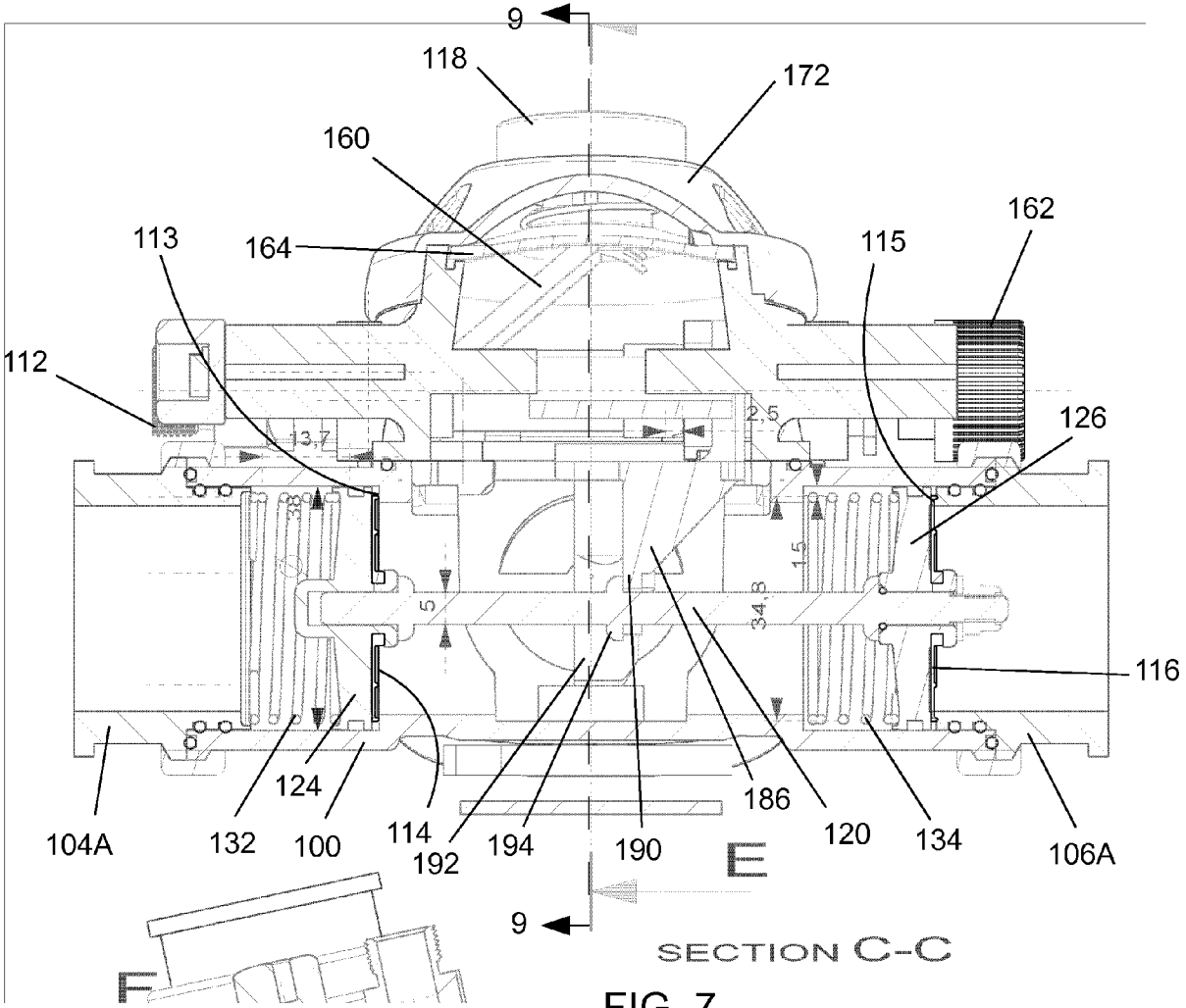
FIG. 7 is a cross-sectional view along line 7-7 in FIG. 4.
Figure 8:
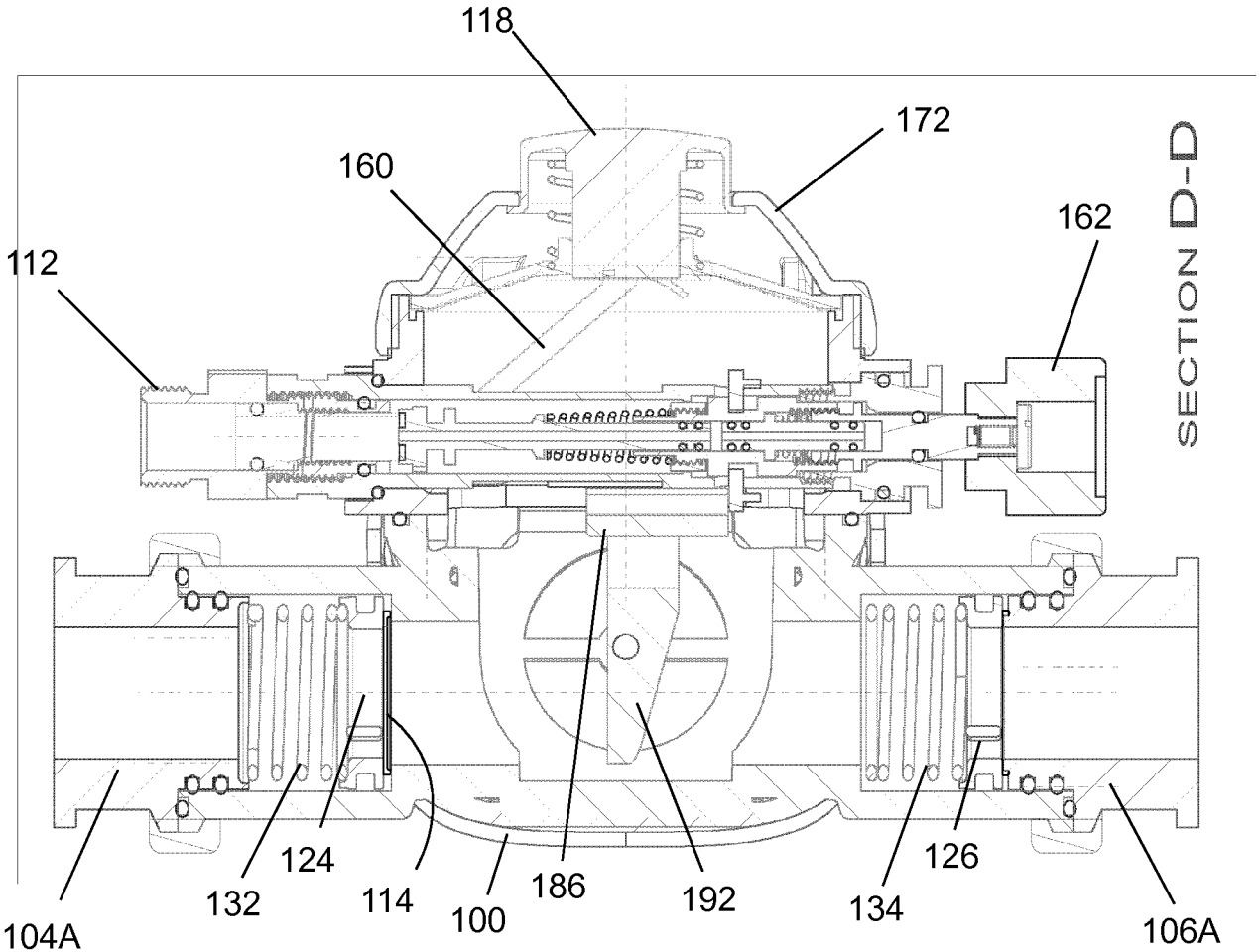
FIG. 8 is a cross-sectional view along line 8-8 in FIG. 4.
Figure 9:
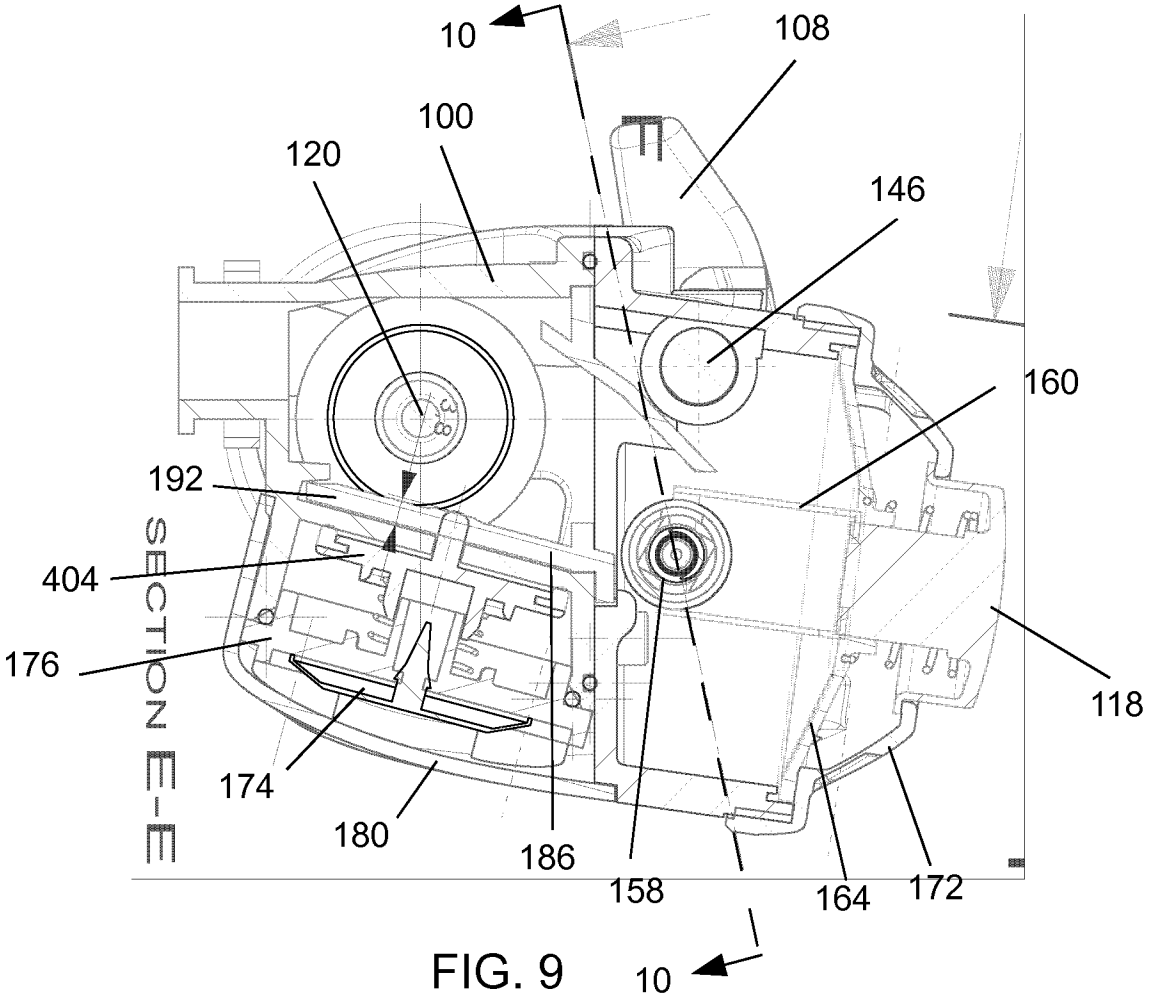
FIG. 9 is a cross-sectional view along line 9-9 in FIG. 7.
Figure 10:
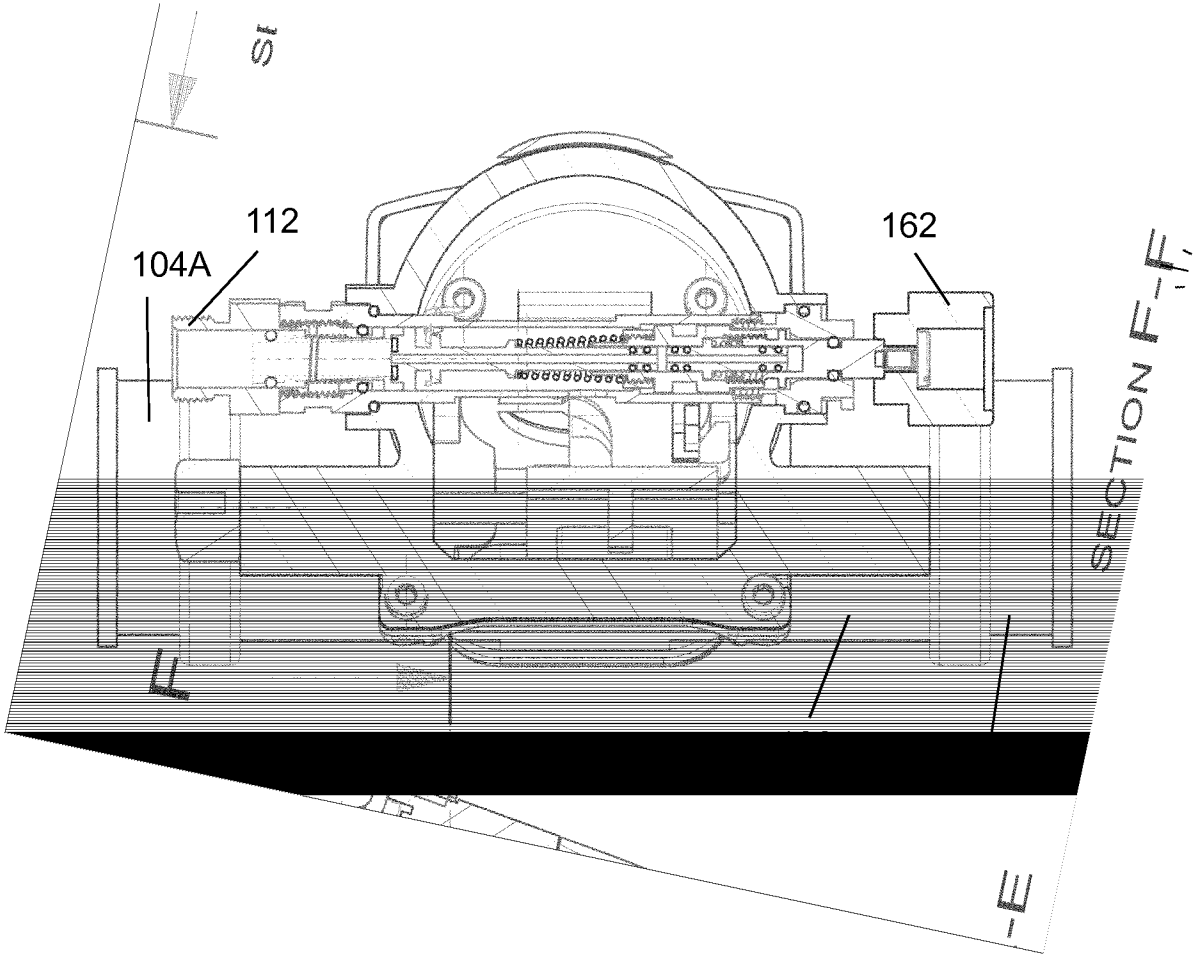
FIG. 10 is a cross-sectional view along line 10-10 in FIG. 9.

In an exemplary embodiment, mode selector 108 may be in a forward and extended position (relative to a user holding mouthpiece 102A in his or her mouth) when the mouthpiece supply valve 20 is in rebreather mode. In this position, mode selector 108 retains BOV release rod 146 in its extended position (towards inlet hose connector 104A) in which BOV spring 150 is compressed and groove 196 retains actuator 186 in a position towards inlet hose connector 104A (its rebreather position). When actuator 186 is in its rebreather position, base portion 192 allows overpressure valve plate 404 to hold overpressure valve sealing ring 408 against the surface of exhaust valve housing 176 due to the force of overpressure valve spring 406, thereby sealing shut bottom opening 175. In addition, when actuator 186 is in its rebreather position, rod 120 is retained in its rebreather position (towards outlet hose connector 106A). With rod 120 in the rebreather position, inlet mushroom valve 114 is held away from its respective shoulder 113, thereby allowing inlet mushroom valve 114 to open when the pressure within main housing 100 is less than the pressure in inlet tubing 104. Similarly, with rod 120 in the rebreather position, outlet mushroom valve 116 is held away from its respective shoulder 115, thereby allowing outlet mushroom valve 116 to open when the pressure within main housing 100 is greater than the pressure in outlet tubing 106 (FIGS. 6 and 7 show the rod 120 in the bail out position).

An exemplary mouthpiece supply valve 20 may operate in rebreather mode as follows. A user may inhale respiration gasses through the mouthpiece connected to mouthpiece connector 102. Due to the pressure differential across inlet mushroom valve 114, inlet mushroom valve 114 may open (and outlet mushroom valve 116 will remain shut), thereby allowing the user to inhale respiration gasses from the rebreather's gas renovation components via inlet tubing 104. The user may then exhale respiration gasses through the mouthpiece connected to the mouthpiece connector 102. Due to the pressure differential across inlet mushroom valve 114, inlet mushroom valve 114 may shut. Similarly, due to the pressure differential across outlet mushroom valve 116, outlet mushroom valve 116 may open, thereby allowing the user to exhale respiration gasses to the rebreather's gas renovation components via outlet tubing 106. Inhalation and exhalation may be repeated as desired by the user.

In an exemplary embodiment, mode selector 108 may be in a rearward and retracted position (e.g., at least a portion of mode selector 108 may engage slot 110) when the mouthpiece supply valve 20 is in bail out mode. In this position, BOV spring 150 holds BOV release rod 146 in its retracted position (towards outlet hose connector 106A) and groove 196 retains actuator 186 in a position towards outlet hose connector 106A (its bail out position). When actuator 186 is in its bail out position, base portion 192 depresses overpressure valve plate 404 (overcoming the force of overpressure valve spring 406), and exhaust diaphragm 174 is fluidicly connected to the interior of main housing 100. In addition, when actuator 186 is in its bail out position, rod 120 is retained in its bail out position (towards outlet hose connector 106A). With rod 120 in its bail out position, spiders 124, 126 hold mushroom valves 114, 116 against the respective shoulders 113, 115 (FIGS. 6 and 7 shown rod 120 in bail out position). This arrangement prevents mushroom valves 114, 116 from opening, regardless of the pressure differential between the interior of main housing 101 and inlet tubing 104 and/or outlet tubing 106.

An exemplary embodiment may operate in bail out mode as follows. A user may inhale respiration gasses through the mouthpiece 102A connected to mouthpiece connector 102. Due to the pressure differential between the ambient environment and the interior of main housing 100, diaphragm 164 may be drawn towards mouthpiece connector 102, which may cause lever arm 160 to pivot towards second stage regulator valve assembly 158. Pivoting lever arm 160 in this direction may actuate the internal valve assembly within second stage regulator valve assembly 158, thereby allowing externally provided respiration gas to enter the interior of main housing 100 via external connection 112. Because exhaust valve plate 404 is held open by actuator 186, exhaust diaphragm 174 is fluidicly exposed to the interior of main housing 100, and the differential pressure between the ambient environment and the interior of main housing 100 may cause exhaust diaphragm 174 to remain shut. The user may then exhale respiration gasses through the mouthpiece 102A connected to the mouthpiece connector 102. Due to the pressure differential across diaphragm 164, lever arm 160 may pivot away from mouthpiece connector 102, thereby causing the internal valve assembly within second stage regulator valve assembly 158 to shut. Similarly, due to the pressure differential across exhaust diaphragm 174, exhaust diaphragm may open, thereby allowing the user to exhale respiration gasses and/or excess fluid to the ambient environment. For example, a user may expel saliva from the user and/or fluid which has entered the loop from outside, such as sea water.

The present disclosure contemplates that if gas is lost from or compressed within the rebreather's respiration loop, additional gas from another source (such as an external compressed gas cylinder) may be added to match the volume of the inhale of the user. The present disclosure contemplates that some rebreather devices incorporate a manual diluent addition valve (MDV) and/or an automatic diluent valve (ADV) to provide such additional gas.

In an exemplary embodiment, depressing button 118 (e.g., towards mouthpiece connector 102) may press against diaphragm 164, thereby pivoting lever arm 160 and causing second stage regulator valve assembly 158 to allow respiration gas to flow into the interior of main housing 100 via external connection 112. In rebreather mode, this may add diluent gas from the external source to the breathing loop, and thereby may act as an MDV. In bail out mode, this may act as a purge button and may supply sufficient gas to the interior of main housing 100 to displace residual fluid or gas in the main housing 100. Displaced residual fluid (such a saliva and/or fluid which has entered the loop from outside, such as sea water) or gas may be discharged to the ambient environment via exhaust diaphragm 174.

An exemplary mouthpiece supply valve 20 may perform ADV functions. With the mouthpiece supply valve 20 in rebreather mode, if gas is lost from or compressed within the rebreather's respiration loop, the pressure within the interior of main housing 100 may be less than ambient pressure. In such circumstances, due to the pressure differential between the ambient environment and the interior of main housing 100, diaphragm 164 may be drawn towards mouthpiece connector 102, which may cause lever arm 160 to pivot towards second stage regulator valve assembly 158. Pivoting lever arm 160 in this direction may actuate the internal valve assembly within second stage regulator valve assembly 158, thereby allowing externally provided respiration gas to enter the interior of main housing 100 via external connection 112. Once the pressure inside main housing 100 reaches and/or exceeds about ambient pressure, diaphragm 164 may be pushed outwards away from mouthpiece connector 102, which may cause lever arm 160 to pivot away from second stage regulator valve assembly 158. Such pivoting may cause the internal valve assembly within second stage regulator valve assembly 158 to shut. In this manner, an exemplary mouthpiece supply valve may perform ADV functions.

The present disclosure contemplates that if the gas volume in the loop should increase, the excess pressure in the device may hinder the user from exhaling into the loop. The present disclosure contemplates that some rebreather devices may include an overpressure relief valve (OPV) to eliminate such excess gas volume.

An exemplary mouthpiece supply valve 20 may perform OPV functions. As discussed above, with the mouthpiece supply valve 20 in rebreather mode, overpressure valve plate 404 holds overpressure valve sealing ring 408 pressed against the surface surrounding bottom opening 175 by overpressure valve spring 406. Thus, exhaust diaphragm 174 is not fluidicly connected to the interior of the main housing 100. If the pressure within the interior of the main housing 100 becomes sufficient to overcome the force of overpressure valve spring 406, overpressure valve plate 404 holding overpressure valve sealing ring 408 will unseat from the surface surrounding bottom opening 175. This will fluidicly connect exhaust diaphragm 174 with the interior of the main housing 100, and exhaust diaphragm 174 will allow excess gas and/or residual fluid (such a saliva and/or fluid which has entered the loop from outside, such as sea water) within main housing 100 to vent to the ambient environment. Once the excess pressure has been vented, exhaust diaphragm 174 and overpressure valve plate 404 will shut.

In an exemplary embodiment, adjustment knob 162 may allow the user to control second stage regulator valve 158 to vary its operation in rebreather mode. In rebreather mode, adjustment knob 162 may vary the supply pressure of the externally supplied gas as utilized by the ADV and MDV functions. In bail out mode, tensioning spring 2 is bypassed, so the adjustment knob 162 does not vary the operation of second stage regulator valve 158.

In some exemplary embodiments, various holes adapted to receive screws may include coil inserts, which may allow metal screws (such as machine screws) to be received in the holes without stripping threads. Such coil inserts may be advantageous in embodiments including a main housing 100 formed of plastic.

As discussed above, an exemplary embodiment may be shifted from rebreather mode to bail out mode by moving mode selector 108 into alignment with slot 110 and allowing BOV spring 150 to retract BOV release rod 146. In some exemplary embodiments, a minimal amount of externally applied energy may be required to shift the mouthpiece supply valve 20 from rebreather mode to bail out mode due to the action of BOV spring 150 and/or other springs biasing BOV release rod 146 and/or valve rod 120 towards the rebreather position. For example, mouthpiece supply valve 20 may be shifted from rebreather mode to bail out mode by merely "tripping" or "unlatching" mode selector 108. In some exemplary embodiments, an automatic actuator may act upon mode selector 108 and/or BOV release rod 146 in a similar manner. An exemplary automatic actuator may operate in response to one or more conditions sensed by one or more sensors, such as one or more gas concentration sensors, chemical reaction sensors, temperature sensors, and the like.

Figure 15:
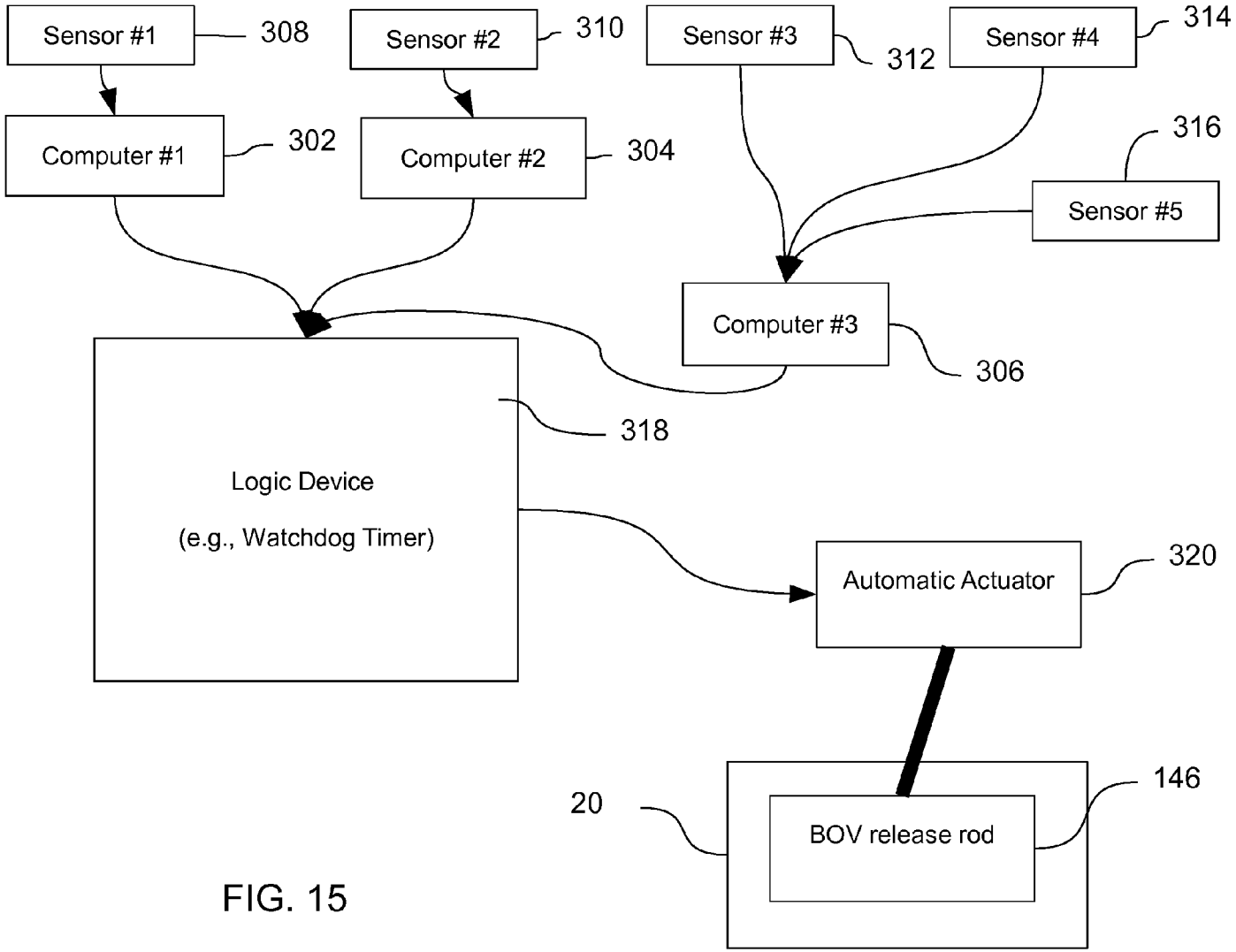
FIG. 15 is a block diagram of an exemplary automatic actuation system.

Referring to FIG. 15, an exemplary automatic actuation system may include one or more (for example, three) computers 302, 304, 306, which may receive signals from one or more sensors 308, 310, 312, 314, 316 and which may be operative to send one or more signals to a logic device 318, such as a watchdog timer. Sensors 308, 310, 312, 314 may provide signals based on any condition relevant to the operation of the rebreather device. For example, some sensors may provide a signal related to the partial pressure of one or more gasses in the respiration loop, such as oxygen sensors (which may be fuel cell type sensors) and/or carbon dioxide sensors. Other exemplary sensors may include liquid detectors, which may be located to detect excessive liquid within the respiration loop and/or flooding of a carbon dioxide absorbent (which may cause a dangerous condition referred to as a "caustic cocktail"), for example. Exemplary liquid detectors may include dual electrode type sensors. Other exemplary sensors may include pressure and/or differential pressure sensors, valve position detectors, and/or temperature sensors, for example. Exemplary sensors may be operative to detect mechanical failures of the rebreather device directly and/or via detection of the results of mechanical failures, such as pressure, temperature, and/or gas concentration conditions.

In an exemplary embodiment, one or more computers 302, 304, 306 may receive signals from more than one sensor 308, 310, 312, 314, 316, such as computer 306 in FIG. 15 which may receive signals from three sensors 312, 314, 316. In such an example embodiment, computer 306 may be programmed to compare the signals received from individual sensors 312, 314, 316 to determine whether one of the sensors 312, 314, 316 has failed. For example, if computer 306 determines that sensor 312 is providing data inconsistent with the data received from sensors 314, 316, computer 306 may be programmed to disregard the data from sensor 312. In such circumstances, computer 306 may act upon data received from the operational sensors.

In an exemplary embodiment, one or more computers 302, 304, 306 may provide inputs to watchdog timer 318. An exemplary watchdog timer 318 may be programmed to reset upon receipt of one or more predetermined inputs from one or more of the computers 302, 304, 306. Computers 302, 304, 306 may be programmed to provide a reset signal when sensed conditions are normal, and/or computers 302, 304, 306 may be programmed to provide no signal or an abnormal signal when sensed conditions are abnormal. The watchdog timer 318 may be programmed such that, if the predetermined inputs associated with normal conditions are not received prior the watchdog timer 318 timing out, the watchdog timer 318 may send a signal to an automatic actuator 320, which may be operatively coupled to BOV release rod 146. For example, if the watchdog timer 318 times out because it has not received one or more predetermined inputs (e.g. reset signals) from one or more of computers 302, 304, 306, watchdog timer 318 may cause the automatic actuator 320 to trip BOV release rod 146, thereby shifting the mouthpiece supply valve 20 from rebreather mode to bail out mode.

In an exemplary embodiment, the watchdog timer 318 may be programmed to consider inputs received from one or more of computers 302, 304, 306 to determine whether one or more of computers 302, 304, 306 has failed. For example, watchdog timer 318 may be programmed to reset upon receipt of reset signals from two of the three computers 302, 304, 306. If the watchdog timer 318 determines that one of computers 302, 304, 306 has failed, it may disregard an input from the failed computer and may reset based upon inputs from the operational computers.

In some exemplary embodiments, one or more sensors 308, 310, 312, 314, 316 may be operatively coupled to more than one computer. In some exemplary embodiments, redundant sensors 308, 310, 312, 314, 316 may be provided. For example, more than one sensor arranged to detect the partial pressure of oxygen at a particular point in the rebreather loop may be provided.

In some exemplary embodiments, automatic actuator 320 may include any device that may be operative to shift the mouthpiece supply valve 20 from rebreather mode to bail out mode. For example, automatic actuator 320 may comprise a normally deenergized solenoid, which may be energized upon receipt of a trip signal from watchdog timer 318. The solenoid may act upon BOV release rod 146 in a manner similar to mode selector 108, thereby shifting the mouthpiece supply valve 20 from rebreather mode to bail out mode. As discussed above, in some exemplary embodiments, the amount of energy exerted by automatic actuator 320 may be relatively minimal due to the action of one or more springs biasing the mouthpiece supply valve 20 towards bail out mode and/or due to the minimal about of energy required to shift mouthpiece supply valve 20 from rebreather mode to bail out mode.

In another exemplary embodiment, automatic actuator 320 may comprise a normally energized solenoid, which may be operative to shift the mouthpiece supply valve 20 from rebreather mode to bail out mode upon deenergization of the solenoid resulting from the timing out of watchdog timer 318. Such an embodiment may also cause the mouthpiece supply valve 20 to shift from rebreather mode to bail out mode upon a loss of power in the rebreather device.

In other exemplary embodiments, the automatic actuator 320 may comprise a pneumatic actuator, a squib (a small pyrotechnic device), a thermal retention device (such as a hard wax that may be partially melted upon application of electric current to a heating device), and/or a piezo crystal actuator.

Although an exemplary embodiment described with reference to FIG. 15 includes a watchdog timer 318, it is within the scope of the disclosure to employ an alternative logic device in addition to or in place of watchdog time 318. For example, an automatic actuation system may include a logic device programmed to provide a trip signal to automatic actuator 320 upon receipt of a predetermined number of abnormal signals from computers 302, 304, 306. For example, receipt of abnormal signals from computers 302, 304 and a normal signal from computer 306 may result in a trip signal to the automatic actuator 320. Further, it is to be understood that the signals provided throughout the automatic actuation system may include normal or non-trip signals and/or abnormal or trip signals. For example, computers 302, 304, 306 may provide normal signals to a logic device, and the logic device may provide a non-trip signal to automatic actuator 320. In the event of an equipment failure and the resulting loss of the normal signal from one or more computers 302, 304, 306, the logic device may cease providing the non-trip signal to the automatic actuator 320, and the automatic actuator 320 may trip the mouthpiece supply valve 20 from rebreather mode to bail out mode.

It is to be understood that computers 302, 304, 306 may comprise computing devices arranged to operate and/or control various components of the rebreather device (e.g., computing devices which control admission of oxygen into the breathing loop via a solenoid valve in response to sensed oxygen partial pressure). In some exemplary embodiments, computers 302, 304, 306 may comprise computing devices separate from computing devices arranged to operate and/or control the rebreather device. In general, computing devices 302, 304, 306 may comprise any device operative to provide a signal to logic device 318 based upon one or more parameters sensed by sensors 308, 310, 312, 314, 316.

Although some of the exemplary embodiments described herein may include a compliant mouthpiece 102A coupled to mouthpiece connector 102, it is within the scope of the disclosure to adapt various exemplary embodiments for use with full face masks, breathing helmets, and other life support devices as would be apparent to one of skill in the art. For example, a valve housing 136 having an alternative shape may be utilized when mouthpiece supply valve 20 is adapted for use with a full face mask.

The present disclosure contemplates that various gas concentration, chemical reaction, and/or temperature sensors may be used to determine if the gas renovation functions are being performed correctly in a rebreather. In addition, if fluid enters the loop, it may be desirable to incorporate a device to remove the excess fluid while maintaining the seal and integrity of the breathing loop.

In accordance with the description herein, exemplary embodiments may provide manual diluent valve, automatic diluent valve, overpressure relief valve, excess fluid ejection, and/or bail-out valve functions all in a single light-weight compact device. Exemplary embodiments may include a spring motivated actuator, which may be actuated manually by the user or automatically by one or more sensors associated with the rebreather, for example, to select the bail out mode should the rebreather fail to provide a breathable gas.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A respiration gas-supply valve assembly for use with a rebreather-type self-contained breathing apparatus, comprising:

at least one sensor operative to produce a sensor signal associated with a sensed condition of at least one of a respiration gas-supply valve assembly and a connected rebreather-type apparatus;

at least one computing device operatively connected to the at least one sensor for producing an output signal associated with the sensor signal; and a mode selection assembly, including an actuator operatively connected to the computing device;

wherein the mode selection assembly is operatively coupled to one or more fluid-flow valves of the respiration gas-supply valve assembly, the mode selection assembly being selectable from at least a first mode in which the one or more fluid-flow valves involve the rebreather-type apparatus as a primary breathable gas source to the respiration gas-supply valve assembly to a second mode in which the one or more fluid-flow valves involve a gas source other than the rebreather-type apparatus as the primary breathable gas source to the respiration gas-supply valve assembly;

wherein the mode selection assembly is operative to configure the one or more fluid-flow valves from the first mode to the second mode based upon receipt of the output signal from the computing device;

wherein the one or more fluid-flow valves includes a secondary regulator valve assembly fluidically provided between the other gas source and the respiration gas-supply valve assembly; and wherein the mode selection assembly is configured to automatically adjust the secondary regulator valve assembly from a first differential pressure setpoint in the first mode to a second differential pressure setpoint in the second mode, the first differential setpoint being higher than the second differential setpoint.

2. The respiration gas-supply valve assembly of claim 1, wherein the actuator includes at least one of a solenoid, a pneumatic actuator, a squib, a thermal retention device, and a piezo crystal actuator.

3. The respiration gas-supply valve assembly of claim 1, wherein the sensed condition is associated with at least one of a partial pressure of a constituent of the respiration gas, a pressure, a temperature, and a component failure.

4. The respiration gas-supply valve assembly of claim 1, wherein the mode selection assembly includes a watchdog timer operative to cause the mode selection assembly to shift from the first mode to the second mode upon completion of a predetermined count; and wherein the output signal includes a reset signal to the watchdog timer when the sensor signal is associated with a normal condition.

5. The respiration gas-supply valve assembly of claim 1, wherein the at least one computing device includes at least two computers; and wherein the at least one sensor includes at least one sensor associated with each of the at least two computers.

6. The respiration gas-supply valve assembly of claim 1, wherein the at least one sensor includes a plurality of sensors, and wherein the at least one computing device produces the output signal based at least partially upon a consistent majority of the sensor signals from the plurality of sensors.

7. The respiration gas-supply valve assembly of claim 1, wherein the mode selection assembly includes a logic device programmed to disregard output signals associated with at least one of computing devices that are determined to be inoperative and sensors that are determined to be inoperative.

8. The respiration gas-supply valve assembly of claim 1, wherein the mode selection assembly includes:

a releasable retainer to maintain the mode selection assembly in the first mode until the releasable retainer is tripped; and a bias urging the mode selection assembly to the second mode.

9. The respiration gas-supply valve assembly of claim 8, wherein the actuator includes at least one of a solenoid, a pneumatic actuator, a squib, a thermal retention device, and a piezo crystal actuator operative to trip the releasable retainer upon receipt of the logic device signal from the logic device.

10. The respiration gas-supply valve assembly of claim 8, wherein the bias is a spring.

11. The respiration gas-supply valve assembly of claim 1, wherein the sensed condition is associated with a malfunction in at least one of the respiration gas-supply valve assembly and the connected rebreather-type apparatus.

12. The respiration gas-supply valve assembly of claim 1, wherein the sensed condition relates to partial pressures of one or more gasses.

13. The respiration gas-supply valve assembly of claim 1, wherein the sensed condition relates to excess liquid within the rebreather-type apparatus.

14. The respiration gas-supply valve assembly of claim 1, wherein the sensed condition relates to a mechanical failure of the rebreather-type apparatus.

15. The respiration gas-supply valve assembly of claim 1, wherein mode selection assembly is operative to configure the one or more fluid-flow valves between the first mode and the second mode based upon receipt of the output signal from the computing device.

16. The respiration gas-supply valve assembly of claim 1, wherein:

the one or more fluid-flow valves include inlet and outlet valves fluidically positioned between the rebreather-type apparatus and the respiration gas-supply assembly; and the mode selection assembly is further configured to automatically open the inlet and outlet valves in the first mode and close the inlet and outlet valves in the second mode.

17. The respiration gas-supply valve assembly of claim 1, wherein:

the one or more fluid-flow valves include an overpressure valve fluidically positioned between the rebreather-type apparatus and an exhaust port to the rebreather-type apparatus; and the mode selection assembly is further configured to automatically adjust the operating pressures of the overpressure valve between the first and second modes.

18. The respiration gas-supply valve assembly of claim 1, wherein the mode selection assembly is configured to automatically adjust the secondary regulator valve assembly to a first differential pressure setpoint in the first mode.

19. A respiration gas-supply valve assembly for use with a rebreather-type self-contained breathing apparatus, comprising:

a respiration gas-supply valve assembly having a housing, the housing including a user intake port for supplying breathable gas to at least one of a user's mouth and nose, a first inlet port for providing fluid communication with a primary source of breathable gas from a rebreather device, a-nd a second inlet port for providing fluid communication with an auxiliary source of breathable gas, and a regulator valve assembly fluidically positioned between the second inlet port and the auxiliary source of breathable gas;

a mode selection assembly, carried by the housing, operative to configure the respiration gas-supply valve assembly to supply breathable gas from the first inlet port to the user intake port in a rebreather mode and operative to supply breathable gas from the second inlet port to the user intake port in a bail out mode;

an actuator operative to manipulate the mode selection assembly from the rebreather mode to the bail out mode; and a computer system operative to automatically actuate the actuator in response to a sensed condition;

wherein the mode selection assembly is configured to automatically adjust the regulator valve assembly to a first differential pressure setpoint in the rebreather mode and a second differential pressure setpoint in the bail out mode, the first differential setpoint being higher than the second differential setpoint.

20. The respiration gas-supply valve assembly of claim 19, wherein the sensed condition is indicative of one or more of a possible malfunction of the rebreather device and a possible malfunction of a component of the air-supply valve assembly.

21. The respiration gas-supply valve assembly of claim 20, wherein the computer system is operative to determine the sensed condition based upon one or more sensor readings received from one or more of an oxygen sensor, a carbon dioxide sensor, a temperature sensor, a pressure sensor, a differential pressure sensor, a valve position detector, and a moisture sensor.

22. The respiration gas-supply valve assembly of claim 19, wherein:

the mode selection assembly includes a releasable retainer to maintain the mode selection assembly in the rebreather mode until the releasable retainer is tripped by the actuator; and a bias urging the mode selection assembly to the bail out mode.

23. The respiration gas-supply valve assembly of claim 22, wherein the bias is a spring.

24. The respiration gas-supply valve assembly of claim 19, wherein the actuator includes at least one of a solenoid, a pneumatic actuator, a squib, a thermal retention device, and a piezo crystal actuator operative to trip the releasable retainer upon receiving an appropriate signal from the computer system.

25. The respiration gas-supply valve assembly of claim 19, wherein the mode selection assembly is operative to configure the respiration gas-supply valve assembly between the rebreather mode and the bail out mode.

26. The respiration gas-supply valve assembly of claim 19, wherein:

the respiration gas-supply valve assembly includes inlet and outlet valves fluidically positioned in the first inlet port; and the mode selection assembly is further configured to automatically open the inlet and outlet valves in the rebreather mode and close the inlet and outlet valves in the bail out mode.

27. The respiration gas-supply valve assembly of claim 19, wherein:

the respiration gas-supply valve assembly includes an exhaust port and an overpressure valve fluidically positioned in the exhaust port; and the mode selection assembly is further configured to automatically adjust the operating pressures of the overpressure valve between the rebreather and bail out modes.

28. The respiration gas-supply valve assembly of claim 19, wherein the mode selection assembly is configured to automatically adjust the regulator valve assembly to a first differential pressure setpoint in the rebreather mode.

* * * * *